US007973753B2

(12) United States Patent
Mori

(10) Patent No.: US 7,973,753 B2
(45) Date of Patent: Jul. 5, 2011

(54) IMAGE DISPLAY DEVICE, IMAGE DISPLAY METHOD, IMAGE DISPLAY PROGRAM, RECORDING MEDIUM CONTAINING IMAGE DISPLAY PROGRAM, AND ELECTRONIC APPARATUS

(75) Inventor: Kenji Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 881 days.

(21) Appl. No.: 11/866,028

(22) Filed: Oct. 2, 2007

(65) Prior Publication Data

US 2008/0100554 A1 May 1, 2008

(30) Foreign Application Priority Data

Oct. 27, 2006 (JP) ..... 2006-292556

(51) Int. Cl.
*G09G 3/36* (2006.01)

(52) U.S. Cl. ..... 345/89; 345/87; 345/88; 345/690

(58) Field of Classification Search ..... 345/87–89, 345/211, 212, 690
See application file for complete search history.

(56) References Cited

U.S. PATENT DOCUMENTS

| | | | | |
|---|---|---|---|---|
| 5,717,422 | A | 2/1998 | Fergason | |
| 6,816,141 | B1 | 11/2004 | Fergason | |
| 7,088,372 | B2 | 8/2006 | Yoshida | |
| 2003/0043165 | A1 * | 3/2003 | Miyachi et al. | 345/589 |
| 2003/0058202 | A1 * | 3/2003 | Evanicky et al. | 345/82 |
| 2003/0122845 | A1 * | 7/2003 | Lee et al. | 345/589 |
| 2004/0036704 | A1 * | 2/2004 | Han et al. | 345/690 |
| 2004/0104877 | A1 * | 6/2004 | Kitagawa | 345/88 |
| 2005/0057486 | A1 * | 3/2005 | Aoki et al. | 345/102 |
| 2005/0270265 | A1 * | 12/2005 | Plut | 345/102 |
| 2006/0232502 | A1 | 10/2006 | Yoshida | |
| 2006/0274026 | A1 * | 12/2006 | Kerofsky | 345/102 |

FOREIGN PATENT DOCUMENTS

| | | |
|---|---|---|
| JP | A 09-244548 | 9/1997 |
| JP | A-2004-12519 | 1/2004 |
| JP | B2 3513312 | 1/2004 |
| JP | A 2004-054250 | 2/2004 |
| JP | A 2004-246099 | 9/2004 |
| JP | A 2004-310671 | 11/2004 |
| JP | A 2004-326082 | 11/2004 |
| JP | A 2006-308631 | 11/2006 |
| JP | A 2006-308632 | 11/2006 |

* cited by examiner

*Primary Examiner* — Amare Mengistu
*Assistant Examiner* — Koosha Sharifi
(74) *Attorney, Agent, or Firm* — Oliff & Berridge, PLC

(57) ABSTRACT

An image display device corrects image data, which are used for displaying an image, using a gray scale value assigned to each pixel and also controls the amount of source light emitted from a light source. The image display device includes a source light amount control device and an image correction device. The source light amount control device determines the amount of source light and then controls the amount of source light. The image correction device corrects a signal used for changing saturations of the image data so as to reduce a change in the saturations due to a change in the amount of source light, the change in the amount of source light being performed by the light source amount control device.

10 Claims, 15 Drawing Sheets

| FIG. 2A | FIG. 2B |
|---|---|

| FIG. 11A | FIG. 11B |
|---|---|

IMAGE DISPLAY DEVICE, IMAGE DISPLAY METHOD, IMAGE DISPLAY PROGRAM, RECORDING MEDIUM CONTAINING IMAGE DISPLAY PROGRAM, AND ELECTRONIC APPARATUS

BACKGROUND

1. Technical Field

The present invention relates to an image display device, an image display method, an image display program a recording medium containing the image display program, and an electronic apparatus, which execute a process on input image data.

2. Related Art

In an existing image display device, such as a laptop computer, that uses a non-luminescent display device, such as a liquid crystal panel, when electric power is not supplied from the outside, image display is performed in such a manner that a light source (for example, cold-cathode tube) converts electric power supplied from a battery to light and the amount of light transmitted through the liquid crystal panel is then controlled. In general, of electric power consumed in the whole device, a percentage of electric power consumed by the light source is relatively large. Then, during battery driving, electric power consumed by the device is reduced by reducing (hereinafter, also referred to as "dimming" where appropriate) the amount of source light emitted from the light source. In addition, when the amount of source light is reduced, visibility decreases with a decrease in luminance of the entire screen. For this reason, there has been a need for technology that is able to balance a reduction in consumed electric power by reducing the amount of source light and retention of visibility.

Japanese Unexamined Patent Application Publication No. 2004-246099, for example, describes a technology that reduces consumed electric power without impairing apparent brightness by converting RGB data to luminance/color difference data (hereinafter, referred to as "YCbCr data") and executing a process of luminance enhancement and a process of reduction in the amount of backlight (dimming) Other than that, Japanese Unexamined Patent Application Publication No. 2004-54250 describes a technology related to the invention.

However, in the technology described in the above JP-A-2004-246099, image quality may possibly decrease due to a decrease in saturations of a display image even when apparent brightness is not changed. In addition, in the technology described in the above JP-A-2004-54250 as well, saturations of a display image may possibly decrease when electric power consumed by a light source is reduced.

SUMMARY

An advantage of some aspects of the invention is that it provides an image display device, an image display method, an image display program, a recording medium containing an image display program, and an electronic apparatus, which are able to appropriately perform dimming of backlight for power saving while effectively suppressing a decrease in saturations of an image.

A first aspect of the invention provides an image display device the image display device corrects image data, which are used for displaying an image, using a gray scale value assigned to each pixel and also controls the amount of source light emitted from a light source. The image display device includes a source light amount control device and an image correction device. The source light amount control device determines the amount of source light and then controls the amount of source light. The image correction device corrects a signal used for changing saturations of the image data so as to reduce a change in the saturations due to a change in the amount of source light, the change in the amount of source light being performed by the light source amount control device.

The image display device is appropriately used to correct image data, which are used for displaying an image, using a gray scale value assigned to each pixel and also to control the amount of source light emitted from a light source. The source light amount control device determines the amount of source light and then controls the amount of source light. In addition, the image correction device corrects a signal used for changing saturations of the image data (that is, corrects color differences) so as to reduce a change in the saturations due to a change in the amount of source light (hereinafter, also referred to as "light control"), the change in the amount of source light being performed by the light source amount control device. Thus, because saturation correction is executed in correspondence with light control, it is possible to execute light control while appropriately suppressing a change in saturations. Hence, it is possible to appropriately execute dimming, for power saving while effectively suppressing a decrease in saturations of an image.

In the image display device, the image correction device may correct the signal so as to reduce a change in an average value of saturations of the image data when the source light control device controls to change the amount of source light. Thus, it is possible to execute light control while effectively suppressing a change in saturations. Thus, it is possible to execute light control (power saving) with higher image quality by effectively suppressing a decrease in saturations.

In the above image display device, the image correction device may correct the signal so that an average value of saturations of image data, in which a signal for changing saturations has been corrected and the source light amount control device has controlled to change the amount of source light, is substantially equal to an average value of saturations of image data which have been corrected from image data, in which a signal for changing saturations has not been corrected, so that the saturations are approximated to a predetermined saturation reference. That is, the correction is executed so that a value obtained by the product of a light control rate and an average value of saturations of image data, in which a signal for changing saturations has been corrected, is substantially equal to an average value of saturations of image data which have been corrected so that the saturations are approximated to a predetermined saturation reference.

In the above image display device, the source light amount control device may determine the amount of source light on the basis of luminances and saturations of the image data. Thus, the source light amount control device is able to determine the amount of source light in consideration of not only the luminances but also the saturations.

In the above image display device, the source light amount control device may determine the amount of source light on the basis of a value specified by the luminances or a value specified by the saturations, whichever is larger. In this manner, the amount of source light may be determined by appropriately detecting a high saturation color and, hence, it is possible to suppress dimming on a high saturation color. Thus, it is possible to appropriately execute dimming for power saving while suppressing a decrease in saturations of image data having a high saturation color. That is, because a high saturation color may be detected even when the luminances of image data are small, it is possible to execute dimming with high image quality while effectively suppressing a decrease in saturations.

In the above image display device, the value specified by the luminances may include an average value of the luminances, the value specified by the saturations may include twice an average value of color differences specified by blue-yellow axis and twice an average value of color differences specified by red-green axis, wherein the source light amount control device may determine the amount of source light on the basis of a maximum value among the average value of the luminances, twice the average value of the color differences specified by blue-yellow axis, and twice the average value of the color differences specified by red-green axis. In this manner, it is possible to appropriately determine a high saturation image on image data that are described by YCbCr. Thus, an additional circuit, such as YCbCr to RGB conversion circuit, for the above determination need not be provided, so that it is not likely to increase costs due to addition of a large circuit.

In addition, in the above image display device, the value specified by the luminances may include an average of the luminances, the value specified by the saturations may include twice an average value of saturations, each of which is defined by taking an average of a color difference specified by blue-yellow axis and a color difference specified by red-green axis, wherein the source light amount control device may determine the amount of source light on the basis of a maximum value among the average value of the luminances and twice the average value of the saturations, each of which is defined by taking the average of a color difference specified by blue-yellow axis and a color difference specified by red-green axis. In this manner as well, it is possible to suppress an increase in costs due to addition of a large circuit.

In the above image display device, the image correction device may correct the signal on the basis of the amount of source light that is determined by the source light amount control device.

In addition, the image display device may be applied to an electronic apparatus provided with a power supply unit that supplies the image display device with voltage.

A second aspect of the invention provides an image display method that corrects image data, which are used for displaying an image, using a gray scale value assigned to each pixel and that controls the amount of source light emitted from a light source. The image display method includes determining the amount of source light and then controlling the amount of source light, and correcting a signal used for changing saturations of the image data so as to reduce a change in the saturations due to a change in the amount of source light by controlling the amount of source light.

A third aspect of the invention provides an image display program that executes a process to correct image data, which are used for displaying an image, using a gray scale value assigned to each pixel and that also executes a process to control the amount of source light emitted from a light source. The image display program has instructions for causing a computer to determine the amount of source light and then control the amount of source light, and correct a signal used for changing saturations of the image data so as to reduce a change in the saturations due to a change in the amount of source light by controlling the amount of source light.

According to the above described image display method and image display program as well, it is possible to appropriately perform dimming of backlight for power saving while effectively suppressing a decrease in saturations in an image.

Note that various computer readable media, such as a flexible disk, a CD-ROM, or an IC card, may be used as a recording medium that contains the image display program.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the accompanying drawings.

First Embodiment

A first embodiment of the invention will be described with reference to the drawings.

General Configuration

Figure 1:
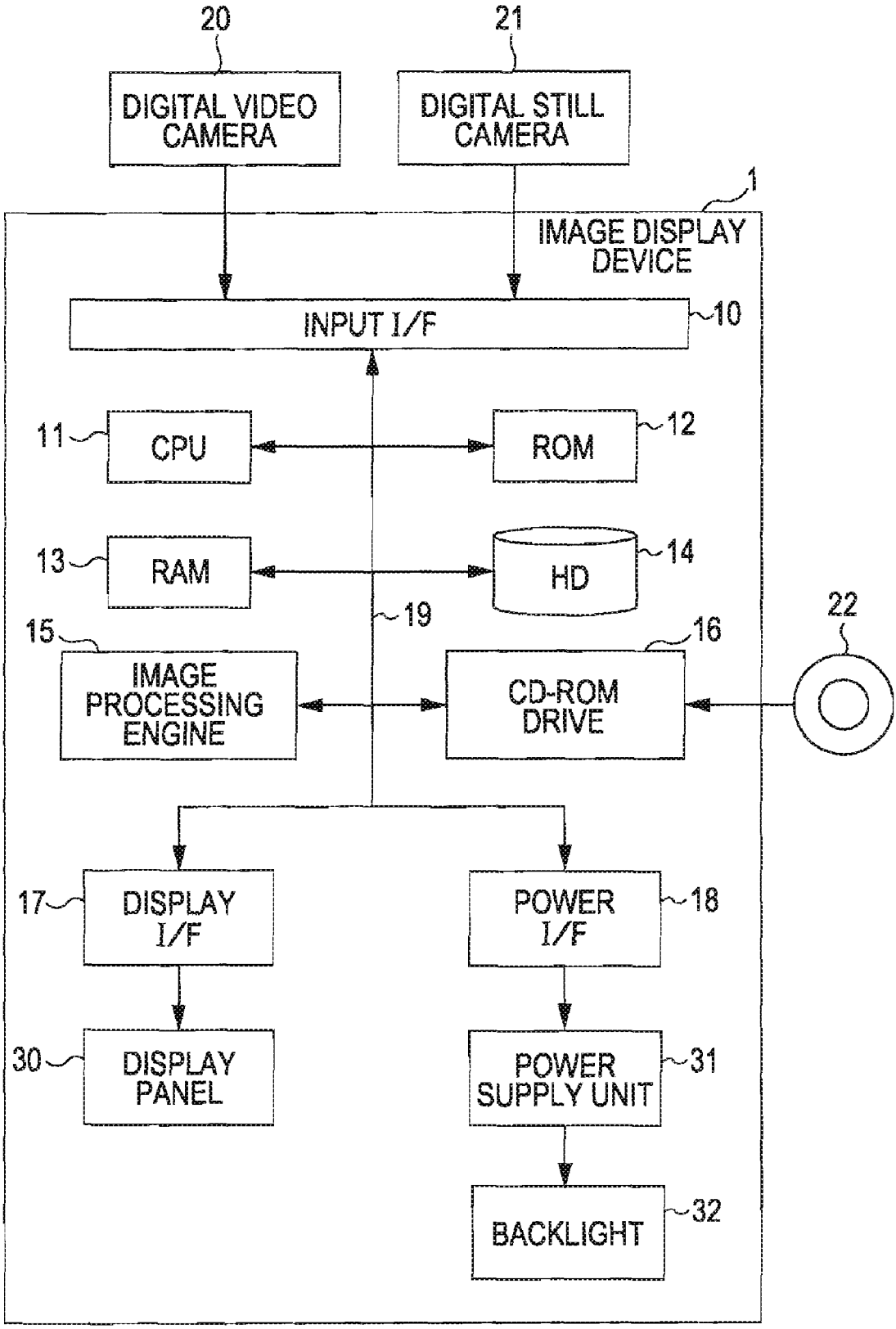
FIG. 1 is a block diagram that schematically shows an image display device according to a first embodiment of the invention.

FIG. 1 is a block diagram that shows the hardware configuration of an image display device according to a first embodiment. As shown in FIG. 1, the image display device 1 includes an input interface (hereinafter referred to as "input I/F") 10, a CPU 11, a ROM 12, a RAM 13, a hard disk (hereinafter, referred to as "HD") 14, an image processing engine 15, a CD-ROM drive 16, a display interface (hereinafter, referred to as "display I/F") 17, and a power I/F 18. These components are connected with each other through a bus 19. In addition, a display panel 30 is connected to the display I/F 17, and a power supply unit 31 is connected to the power I/F 18. Note that a specific example of the image display device 1 may be a laptop computer, a projector, a television, a mobile telephone, and the like, which are able to display an image using the display panel 30. Furthermore, the image processing engine 15 may be arranged not in a main bus but in an exclusive bus between an image input (I/O of the CPU, DMA from communication/external device, or the like) and an image output.

A digital video camera 20, a digital still camera 21, or the like, is connected to the input I/F 10 as a device that inputs a dynamic image. In addition, images distributed through a network device, images distributed through radio wave, and the like, are also input through the input I/F 10 to the image display device 1.

The CPU 11 is a section that controls various processes executed in the image display device 1. Particularly when dynamic image data are input through the input I/F 10 or dynamic images stored in the HID 14 are reproduced, the CPU 11 transfers dynamic image data to the image processing engine 15 and then instructs the image processing engine 15 to display the dynamic image.

The power supply unit 31 supplies electric power stored in a battery that is set inside the power supply unit 31 or electric power supplied from the outside of the image display device 1, to various components, including a backlight 32, of the image display device 1.

The backlight 32 is a light source, such as a cold-cathode tube or an LED (light emitting diode); that converts electric power, which is supplied from the power supply unit 31, to light. Light emitted from the backlight 32 is diffused by various sheets interposed between the backlight 32 and the display panel 30 and is irradiated toward the display panel 30 as substantially uniform light.

The display panel 30 is a transmissive liquid crystal panel. The display panel 30 modulates light in accordance with a driving signal corresponding to image data that are Input through the display I/F 17 and controls a transmittance ratio of the amount of light that is received from the backlight 32 to the amount of light that is transmitted through the display panel 30 for each pixel. Thus, the display panel 30 displays a color image. Note that, because the display panel 30 performs display by controlling a transmittance ratio of light, the luminances of an image which will be displayed vary in proportion to the amount of light supplied from the backlight 32.

Configuration of Image Processing Engine

Figures 2, 2A:
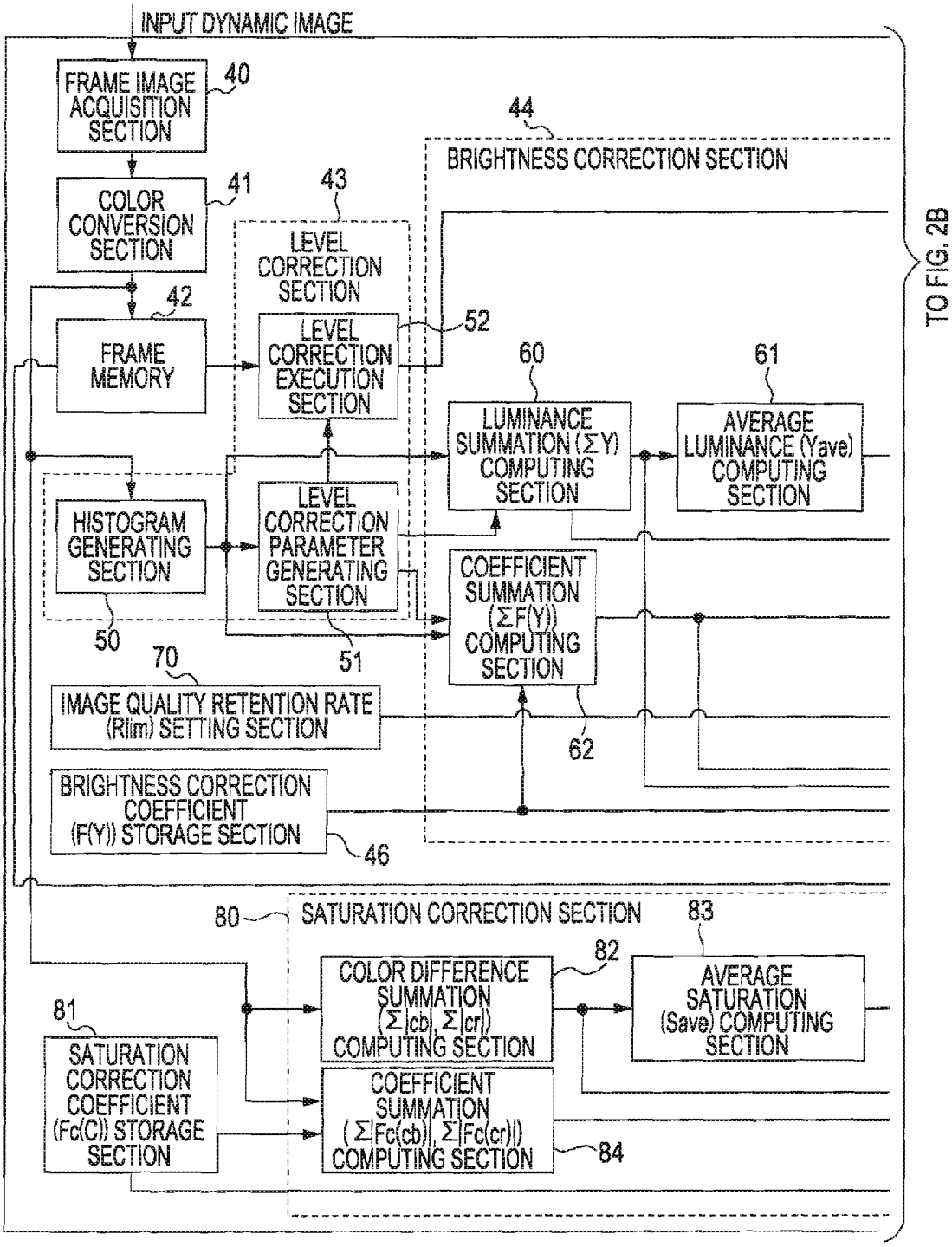
FIG. 2 is a view that shows the configuration of an image processing engine according to the first embodiment of the invention.
Figure 2B:
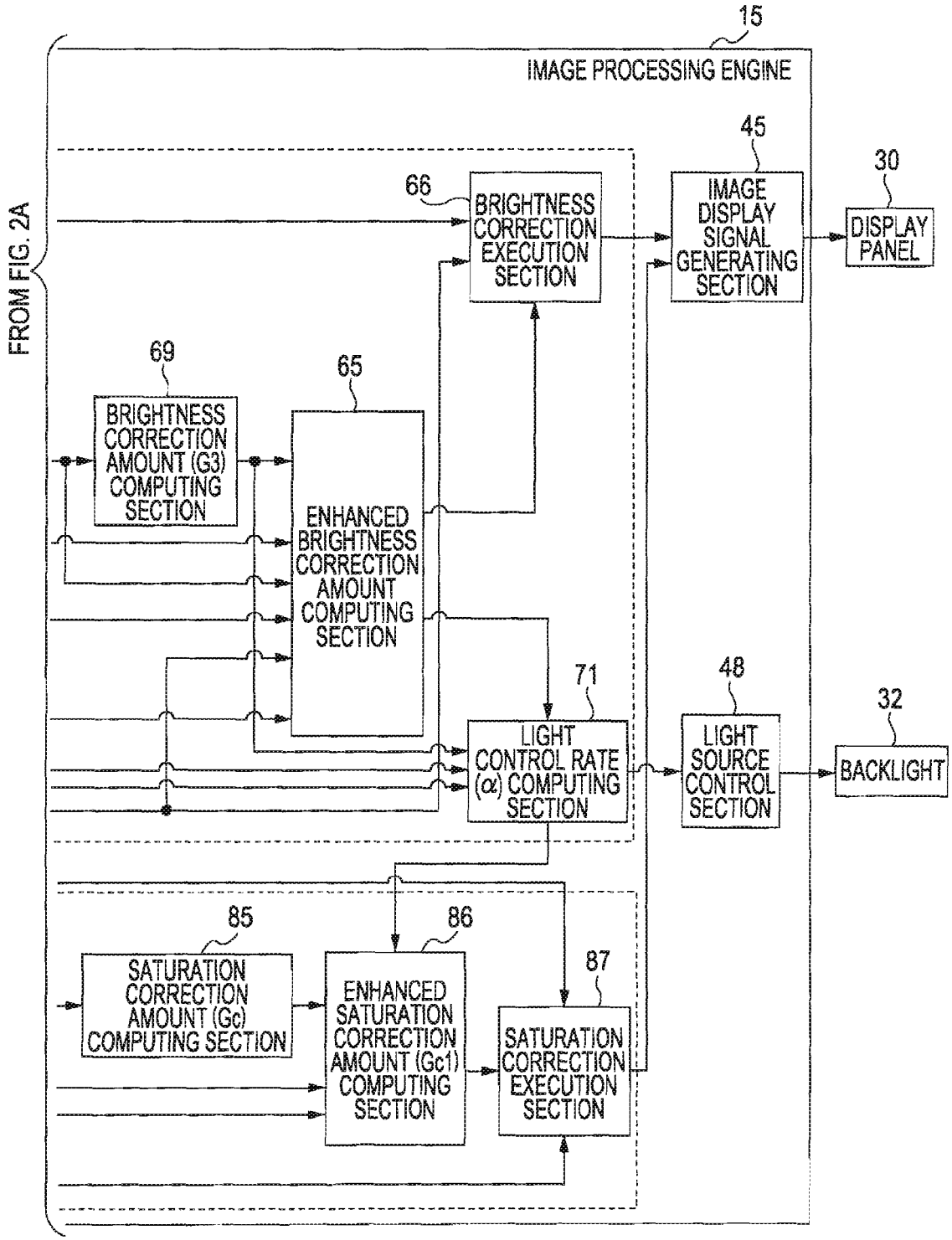

FIG. 2 is a view that shows the configuration of the image processing engine according to the first embodiment. As shown in FIG. 2, the image processing engine 15 includes a frame image acquisition section 40, a color conversion section 41, a frame memory 42, a level correction section 43, a brightness correction section 44, an image display signal generating section 45, a brightness correction coefficient (F(Y)) storage section 46; a light source control section 48, an image quality retention rate (Rlim) setting section 70, a saturation correction section 80, and a saturation correction coefficient (Fc(C)) storage section 81.

Specifically, the level correction section 43 includes a histogram generating section 50, a level correction parameter generating section 51, and a level correction execution section 57. In addition the brightness correction section 44 includes a luminance summation (ΣY) computing section 60, an average luminance (Yave) computing section 61, a coefficient summation (ΣF(Y)) computing section 62, a brightness correction amount (G3) computing section 69, an enhanced brightness correction amount computing section 65, a brightness correction execution section 66; and a light control rate (α) computing section 71. Furthermore, the saturation correction section 80 includes a color difference summation (Σ|cb|, Σ|cr|) computing section 82, an average saturation (Save) computing section 83, a coefficient summation (Σ|Fc(cb)|, Σ|Fc(cr)|) computing section 84, a saturation correction amount (Gc) computing section 85, an enhanced saturation correction amount (Gc1) computing section 86, and a saturation correction execution section 87. The thus configured image processing engine 15 is formed of a hardware circuit, such as an ASIC. The following will describe processes executed by the above sections.

The frame image acquisition section 40 sequentially acquires image data of a frame image, which is an image of each frame of a dynamic image, from dynamic image data that are input through the input I/F 10 to the image display device 1.

In addition, the input dynamic image data are data that indicate a plurality of still images (hereinafter, referred to as "frame images") that are successive in time sequence, for example. The dynamic image data may be compressed data or the input dynamic image may be interlaced data. In such a case, the frame image acquisition section 40 executes extraction of the compressed data, or executes conversion of the interlaced data to non-interlaced data. Thus, the frame image acquisition section 40 converts image data of each frame image of dynamic image data to image data of a type that can be handled by the image processing engine 15 to acquire the image data. Note that, when still image data are input, the frame image acquisition section 40 is also able to handle a still image by acquiring image data of the still image.

In the present embodiment, for a large number of pixels that are arranged in a matrix, for example, of 640 by 480 pixels, YCbCr data, which are represented mainly using Y (luminance), Cb(U) (color difference specified by blue-yellow axis) and Cr(V) (color difference specified by red-green axis), are acquired as image data. In this case, "$0 \leqq Y \leqq 255$", "$-128 \leqq Cb, Cr \leqq 127$", and "Cb, Cr=0" indicate a gray axis. Note that the number of pixels that display a frame image and the number of gray scale levels of each pixel are not limited to it. In addition, as to the model describing image data as well, it is not limited to YCbCr data. It may be data using various models, such as RGB data that use 256 gray scale values, that is, "0" to "255" (8-bit) for respective colors R (red), G (green), and B (blue).

The color conversion section 41 converts the image data, which are acquired by the frame image acquisition section 40, to luminance data and color difference data. Specifically, the color conversion section 41 changes the acquired image data to YCbCr data. More specifically, the color conversion section 41, when the acquired data are YCbCr data, does not execute color conversion. Only when the acquired image data are RGB data, the color conversion section 41 executes color conversion. Specifically, when the acquired image data are RGB data, the color conversion section 41 calculates conversion equation, for example, indicated as follows to convert the RGB data to YCbCr data $$Y=0.299R+0.587G+0.114B \quad \text{Equation (1)}$$

$$Cb=-0.1684R-0.3316G+0.5000B \quad \text{Equation (2)}$$

$$Cr=0.500R-0.4187G-0.0813B \quad \text{Equation (3)}$$

Note that the color conversion section 41 may store a color conversion table that contains the conversion results of Equation (1) to Equation (3) for each gray scale levels (0 to 255) of RGB and then convert the image data to gray scale values that use 256 gray scales (8-bit) on the basis of the color conversion table.

The image data processed in the color conversion section 41 are stored in the frame memory 42. Specifically, the frame memory 42 keeps image data of one screen. Note that the image processing engine 15 may be configured without the frame memory 42. When the image processing engine 15 includes the frame memory 42, it is possible to execute a process on the frame from which an image characteristic amount is extracted. However, when the image processing engine 15 does not include the frame memory 42, it is also possible to execute a process using an image characteristic amount of the previous frame.

Figure 3:
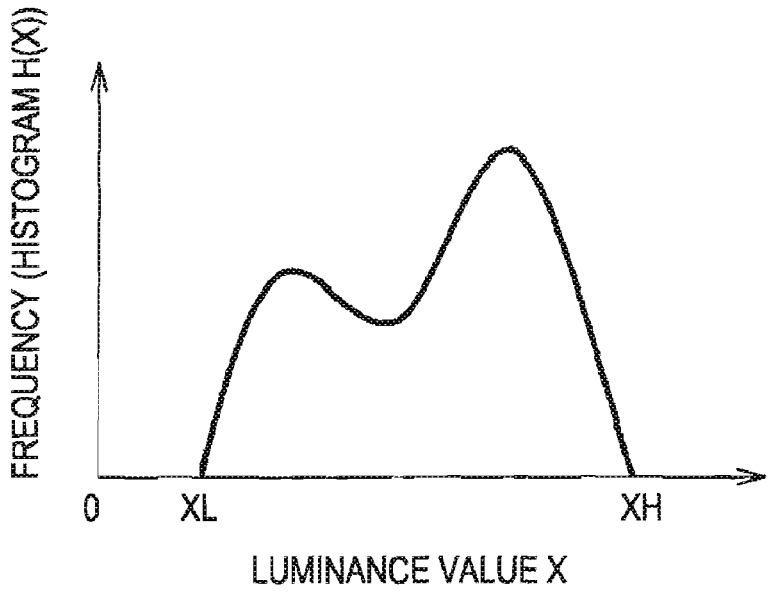
FIG. 3 is a view that shows the histogram of a frame image.

The level correction section 43 receives luminance values X from the color conversion section 41 and executes level correction for expanding a region in which the luminance values X are distributed. Thus, the level correction section 43 acquires luminance values Y. When in the level correction, the histogram generating section 50 initially calculates a histogram of luminance data X of a frame image, and the level correction parameter generating section 51 acquires the upper limit value XH and lower limit value XL of the luminance values X of the frame image through the histogram as level correction parameters. For example, when the histogram as shown in FIG. 3 is produced, it is possible to acquire the upper limit value XH and the lower limit value XL from the histogram H(X). Note that the upper limit value XH corresponds to the maximum luminance value in the histogram H(X), and the lower limit value XL corresponds to the minimum luminance value in the histogram H(X). However, in order to reduce a noise in a frame image and an influence contained in non-image data, such as caption or time display, the upper limit value XH and the lower limit value XL may be obtained from among luminance values X equal to or above a predetermined frequency in the histogram H(X). In addition, the upper limit value XH and the lower limit value XL may also be obtained from among luminance values at which an approximate curve obtained from the histogram H(X) intersects with X-axis or from among luminance values at which the approximate curve is equal to or above a predetermined value.

Figure 4:
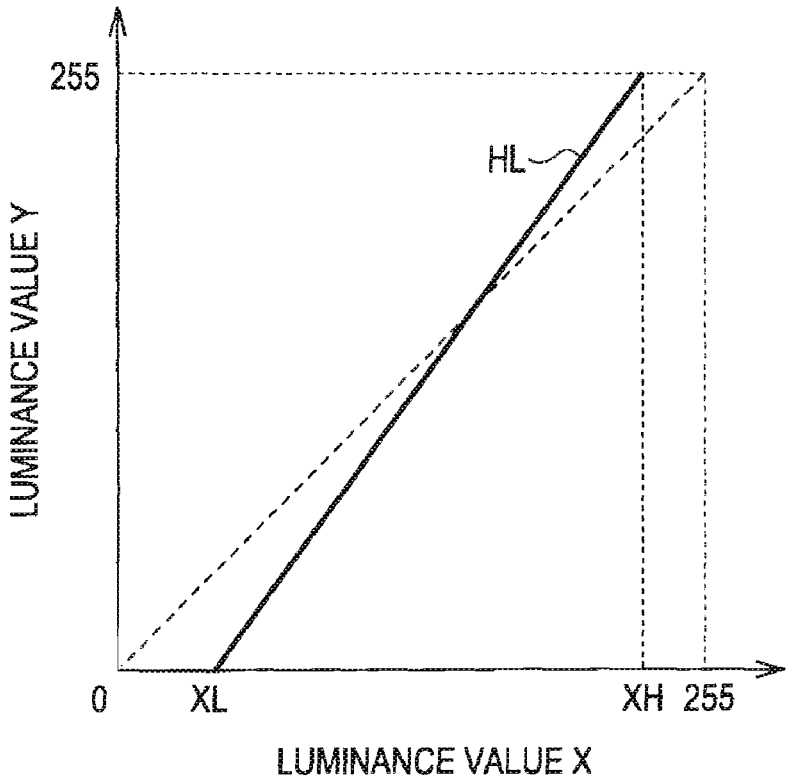
FIG. 4 is a view that shows an example of a correction line for level correction.

The level correction execution section 52, as shown in FIG. 4, linearly transforms a region between the upper limit value XH of the frame image and the lower limit value XL of the frame image into a maximum region of luminance values that can be presented in luminance data, thus converting the luminance values X to the luminance values Y. That is, because the number of gray scale levels describing luminance values is defined as 256 gray scale levels, that is, "0 to 255", in the first embodiment, the level correction is executed using the following equation.

$$Y(X)=255\times(X-XL)/(XH-XL) \quad \text{Equation (4)}$$

By expanding the region of gray scale levels of the image data of the frame image in accordance with Equation (4), it is possible to enhance the contrast of the frame image.

The following will describe the process executed by the brightness correction section 44. The brightness correction section 44 executes brightness correction so that the brightness is approximated to a predetermined brightness reference. Specifically, the luminance values Y, for which level correction has been executed, are converted to luminance values Y" in accordance with the following equation.

$$Y''=F(Y)\times G3+Y \quad \text{Equation (5)}$$

In Equation (5), "Y" is a luminance value, for which level correction has been executed, "G3" is an amount of brightness correction (hereinafter, referred to as "brightness correction amount") at a predetermined luminance value, and "F(Y)" is a brightness correction coefficient that indicates a ratio of a correction value to the reference correction amount G3 at each of the luminance values Y. The following will describe a method of determining a correction curve shown in Equation (5), that is, a method of determining a brightness correction coefficient F(Y) and a brightness correction amount G3 one by one.

Figure 5A:
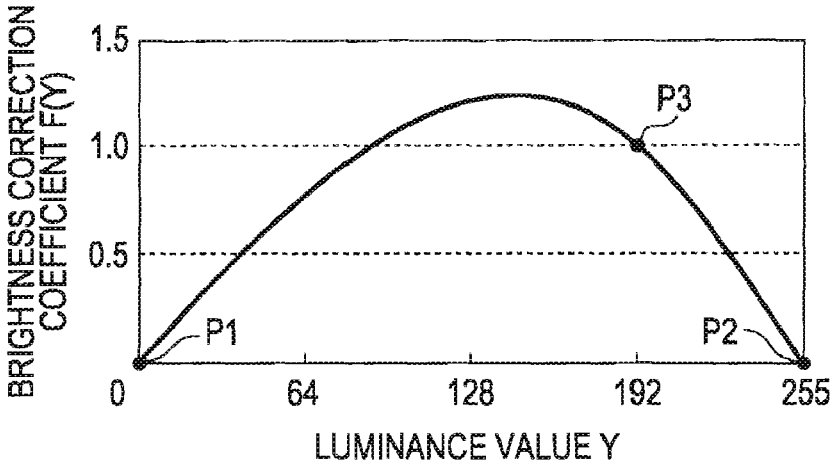
FIG. 5A to FIG. 5C are views that show the relationship between luminance values and brightness correction coefficients.
Figure 5B:
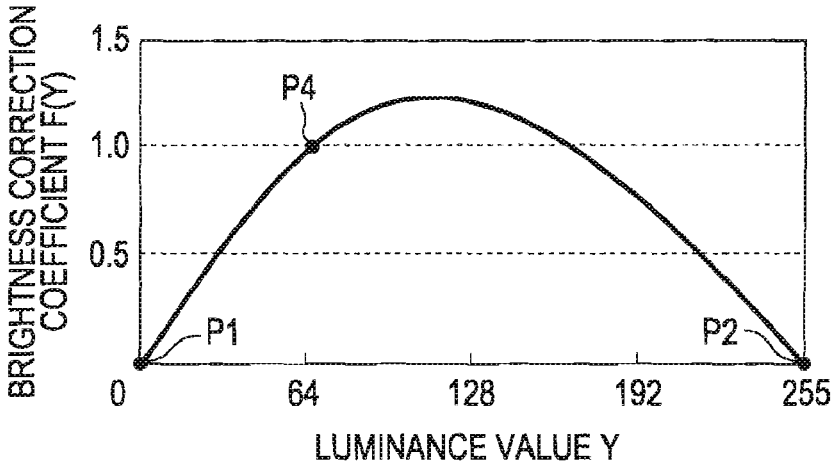
Figure 5C:
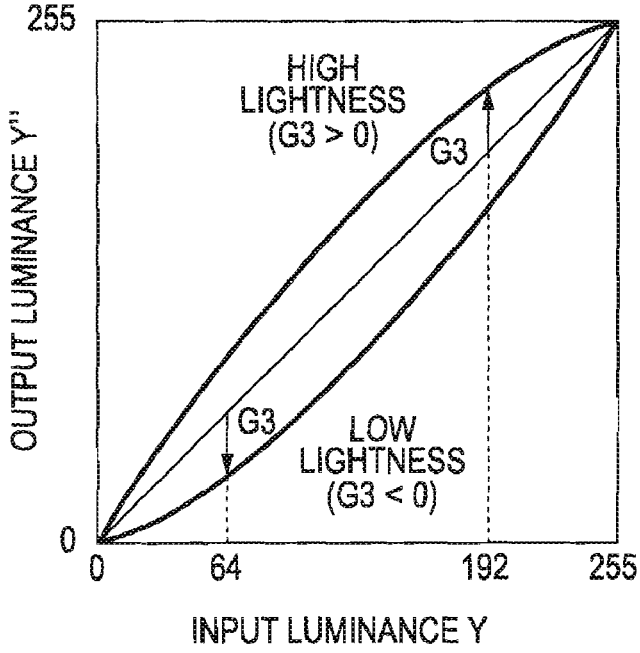

The brightness correction coefficient F(Y) employs a function that is determined in advance. FIG. 5A to FIG. 5C are views that show the relationship between the luminance values Y and the brightness correction coefficients F(Y). The brightness correction coefficients F(Y) employ a curve of which a correction point is defined at "192" as a gray scale value of correction reference, as shown in FIG. 5A, and also employ a curve of which a correction point is defined at "64" as a gray scale value of correction reference, as shown in FIG. 5B. The brightness correction coefficients F(Y), when the correction point is defined at "192", as shown in FIG. 5A, are shown by a curve that passes P1(0,0), at which F(Y) is "0" and the luminance value is "0", and P2(255,0), at which F(Y) is "0" and the luminance value is "255", and P3(192,1), at which F(Y) is "1" and the luminance value is "192", that is, the correction point. In other words, in the present embodiment, the brightness correction coefficients F(Y) are given as a function that is shown by a cubic spline curve. The data of the brightness correction coefficients F(Y) shown in FIG. 5A to FIG. 5C are stored in the brightness correction coefficient storage section 46 in advance as a table that gives values of F(Y) corresponding to gray scale levels (0 to 255) of the luminance values Y.

Thus, the image display device 1 according to the first embodiment includes two types of brightness correction coefficients F(Y) and uses one of the correction coefficients F(Y) depending on positive value or negative value of the brightness correction amount G3. Specifically, when the brightness correction amount G3 is positive, the brightness correction coefficients F(Y) that employ "192" as the correction point are used. On the other hand, when the brightness correction amount G3 is negative, the brightness correction coefficients F(Y) that employ "64" as the correction point are used. Thus, as shown in FIG. 5C, the luminance values Y (input luminances) are converted depending on positive value or negative value of the brightness correction amount G3. That is, the above Equation (5) indicates a correction curve that is convex upward or downward in accordance with the sign of the brightness correction amount G3. Specifically, the brightness correction amount G3 is given as the following equation.

$$G3=Ga(Yth-Yave) \quad \text{Equation (6)}$$

In Equation (6), "Ga" is a brightness correction intensity coefficient that is a predetermined value equal to 0 or above, and "Yth" is a brightness reference (that is, a reference gray scale value) As is apparent from Equation (6), the brightness correction amount G3 is proportional to a value obtained by subtracting the average value Yave of the luminances from the brightness reference Yth, so that, when the luminance values Y are corrected in, accordance with the brightness correction amount G3, the luminance values Y are corrected so as to be approximated to the brightness reference Yth. Thus, it is possible to reduce biased luminance values of image data. Note that the value of the brightness correction intensity coefficient Ga and the brightness reference Yth may be determined as constants in advance or may be set by a user. Alternatively, the value of the brightness correction intensity coefficient Ga and the brightness reference Yth may be determined in coordination with types of image data.

Note that the brightness correction may be executed through Equation (5) when the brightness correction amount G3 is determined; however, actually in the present embodiment, the brightness correction amount G3 that is calculated in the brightness correction amount computing section 69 is transferred to the enhanced brightness correction amount computing section 65 as a parameter without calculation of Equation (5).

Here, a parameter used to reduce the amount of light emitted from the backlight 32 below a predetermined amount of light and to reduce the luminances of an image that is displayed on the display panel 30 is defined as "α" ("α" corresponds to a light control rate). In this case, the light control rate α is positive number and is 1 or below, so that, when the light control rate α is "1", the backlight 32 emits a predetermined maximum amount of light. That is, the amount of light is always controlled by dimming relative to a predetermined amount of light. In addition, the light control rate α is a rate that is linearly related to stimulus given to the visual sense of a human being. In other words, the rate is made in consideration of sensitivity characteristic of the visual sense of a human being, so that, when the light control rate α is "0.5", for example, the stimulus given to the visual sense of a human being by the luminances of an image displayed on the display panel 30 is 50% of the stimulus when the light control rate α is "1".

The brightness correction section 44, by further executing correction in accordance with the following equation, executes correction to reduce variation in luminances, which occurs in an image displayed due to light control while correcting biased luminance values (hereinafter, this correction is termed as "enhanced brightness correction"). The correction equation of the enhanced brightness correction is defined by the following equation.

$$Z(Y)=F(Y)\times G4+Y \qquad \text{Equation (7)}$$

Here, a correction amount G4 is determined so that the product of the average value of luminance values Z, for which enhanced brightness correction is executed, and the light control rate α is equal to the average value of the luminance values Y" (hereinafter, "correction amount G4" is termed as "enhanced brightness correction amount G4"). That is, the enhanced brightness correction amount G4 is determined so as to satisfy the following Equation (8).

$$\alpha\times Z\text{ave}=Y''\text{ave} \qquad \text{Equation (8)}$$

Equation (8) indicates that the luminances that display an image based on the luminance values Y" are visually made equal to the luminances that display an image based on the luminance values Z after light control. Here, the right-hand side and left-hand side of Equation (8) may be expressed as the following equation.

$$Y''\text{ave}=\Sigma Y''/N=(\Sigma F(Y)\times G3+\Sigma Y)/N \qquad \text{Equation (9)}$$

$$Z'\text{ave}=\Sigma Z'/N=(\Sigma F(Y)\times G4+\Sigma Y)/N \qquad \text{Equation (10)}$$

Through Equation (8) to Equation (10), the following equation that expresses the enhanced brightness correction amount G4 may be obtained.

$$G4=G3/\alpha+(1-\alpha)\Sigma Y/(\alpha\Sigma F(Y)) \qquad \text{Equation (11)}$$

Here, the enhanced brightness correction amount G4 that appears in Equation (11) is not as a function of the luminance values Y" but as a function of the brightness correction amount G3, so that the brightness correction section 44 is able to calculate the enhanced brightness correction amount G4 on the basis of the brightness correction amount G3 without calculation using Equation (5) actually. Using the thus calculated enhanced brightness correction amount G4, it is possible to execute enhanced brightness correction that reduces variation in luminances due to light control after biased luminance values have been corrected.

Figure 6:
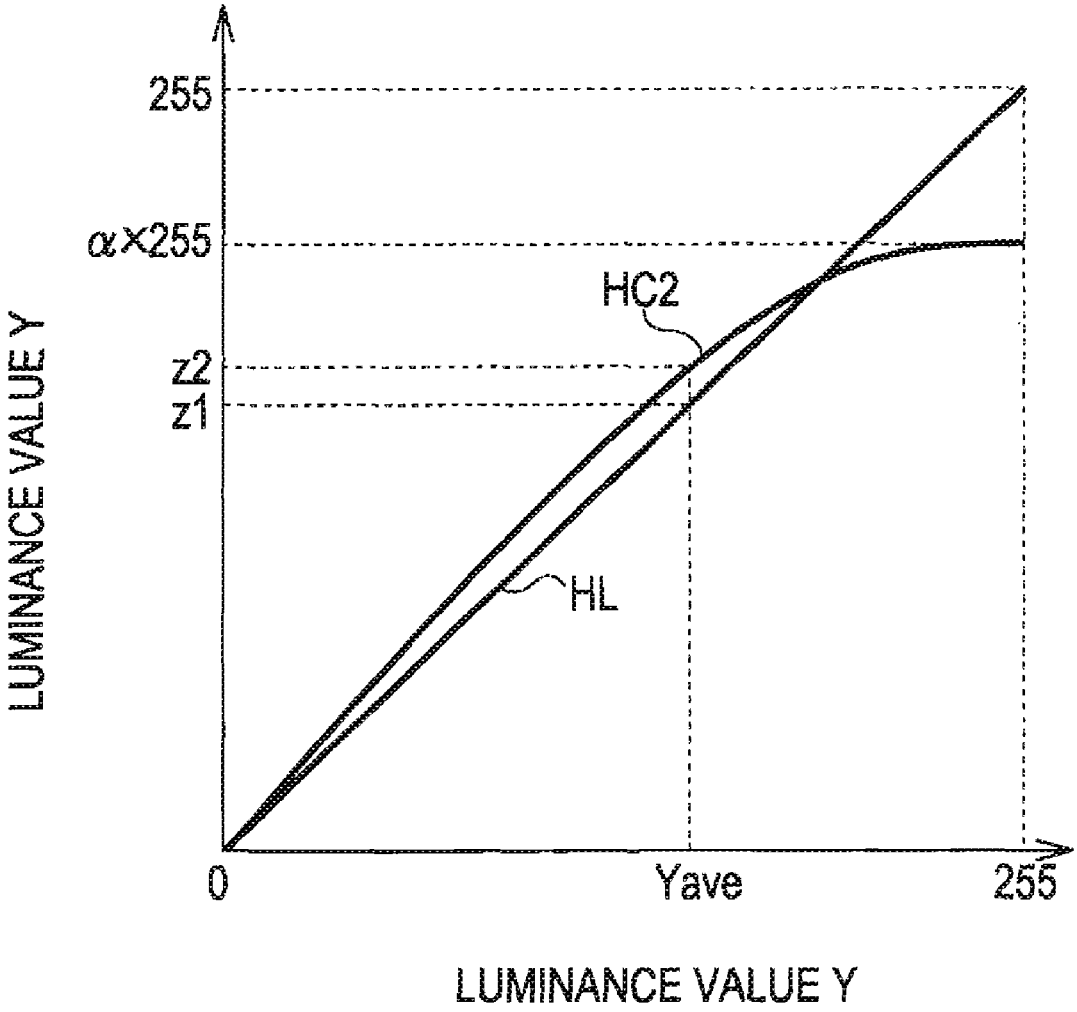
FIG. 6 is a view that shows a correction curve for brightness correction when an enhanced brightness correction amount takes a positive value.

Here, as described above, when the brightness correction is executed, there is a possibility that a contrast corresponding to a high luminance region is reduced. FIG. 6 is a view that shows a correction curve HC2 of brightness correction when "G3=0" in Equation (5), that is, when dimming is performed without brightness correction, and the average luminance is then made equal to the resulting value. In other words, FIG. 6 shows the correction curve HC2 of brightness correction when the enhanced brightness correction amount G4 takes a positive value. In addition, in FIG. 6, the gray scale line of the luminance values Y, when level correction is performed, is shown by a correction line HL. As shown in FIG. 6, the gray scale levels of the correction line HL, when no brightness correction is performed, corresponding to luminances higher than the average luminance Yave, range from z1 (=Yave) to 255. When the brightness correction is executed by the upward convex gray scale curve HC2 using the brightness correction amount G3 (>0), the range of luminance values obtained by multiplying luminance values Z, corresponding to the range of Yave to 255 of the luminance values Y higher than the average value Yave of the luminances Y, by the light control rate α is from z2 (=α×Z(Yave)) to 255×α according to the correction curve HC2. Thus, the range of luminances from z2 to 255×α, which correspond to the luminances Y equal to Yave or above, is made narrower than the original range of luminances from z1 to 255. That is, because the range of luminance values that allow to present high and low of luminance values is made narrow, the contrast is decreased. Then, in the present embodiment, in order to suppress a decrease in contrast on the high luminance side due to light control within a certain level, the value of the light control rate α is restricted.

On the higher gray scale side than the luminance value corresponding to the average luminance value Yave of the luminance values Y, including when the brightness correction amount G3 is not 0, a gray scale difference L1 of the luminance values Y" without light control and a gray scale difference L2 of effective luminance values α×Z' with light control may be expressed as the following equations.

$$L1=255-Y''(Y\text{ave})=255-(F(Y\text{ave})\times G3+Y\text{ave}) \qquad \text{Equation (12)}$$

$$L2=\alpha\times 255-\alpha\times Z'(Y\text{ave})=\alpha\times(255-(F(Y\text{ave})G4+Y\text{ave})) \qquad \text{Equation (13)}$$

Then, from Equation (12) and Equation (13), a contrast retention rate R and an equation when the contrast retention rate R is limited to Rlim (which is set by an image quality retention rate setting section 70, which will be described later) are determined as the following equations.

$$R=L2/L1=\alpha\times(255-(F(Y\text{ave})G4+Y\text{ave}))/(255-(F(Y\text{ave})\times G3+Y\text{ave})) \qquad \text{Equation (14)}$$

$$Rlim=\alpha lim\times(255-(F(Y\text{ave})G4lim+Y\text{ave}))/(255-(F(Y\text{ave})\times G3+Y\text{ave})) \qquad \text{Equation (15)}$$

"αlim" in Equation (15) indicates a limit light control rate, and "G4*lim*" indicates a limit correction amount. Here, the limit light control rate αlim may be expressed as the following equation.

$$\alpha lim(\Sigma F(Y)\times G3+\Sigma Y)/(\Sigma F(Y)\times G4lim+\Sigma Y) \qquad \text{Equation (16)}$$

In addition, under the condition of Equation (8), using Equation (9), Equation (10) and Equation (15), the limit correction amount G4*lim* may be determined as the following Equation (17).

$$G4\lim = \frac{\{R\lim \times F(Yave) \times \Sigma Y + (255 - Yave) \times \Sigma F(Y)\} \times G3 + (1 - R\lim) \times (255 - Yave) \times \Sigma Y}{(1 - R\lim) \times F(Yave) \times \Sigma F(Y) \times G3 + F(Yave) \times \Sigma Y + R\lim \times (255 - Yave) \times \Sigma F(Y)} \quad \text{Equation (17)}$$

By substituting Equation (16) using the thus obtained limit correction amount G4*lim*, the limit light control rate αlim may be obtained.

The above limit correction amount G4*lim* and the limit light control rate αlim are respectively used as a final correction amount G4' and a final light control rate α', which are actually used for correction, so that it is possible to appropriately execute light control while retaining an optimum image quality with constantly the same reference (Rlim) relative to an image. In addition, by executing correction with Equation (7) using the final correction amount G4', it is possible to execute brightness correction when the light control rate α is limited to the final light control rate α'. That is when the luminance values, which are corrected when the light control rate α is limited to the final light control rate α', are Z', the brightness correction is executed in accordance with the following equation.

$$Z'(Y) = \Sigma F(Y) \times G4' + Y \quad \text{Equation (18)}$$

On the other hand, the image quality retention rate setting section 70 sets Rlim (which is a value corresponding to a value to limit a decrease n contrast) in advance before image display through writing into a register by the CPU 11. For example, the image quality retention rate setting section 70 refers to the residual amount of power stored in a battery mounted in the image display device 1 and then estimates a value such that the image display device 1 can drive for a predetermined target driving time, thus setting the Rlim. However, setting of the Rlim is not limited to it. The Rlim may be switched to a predetermined value in response to switching to a power saving mode in which power consumption is suppressed when the power source that supplies power to drive the image display device 1 is switched from an external power source to the battery, or the like. In addition, it is applicable that a user arbitrarily sets the Rlim by, for example, displaying a screen for power saving setting on the display panel 30. In order to prevent steep dimming and steep variation in image quality, they may be gradually switched frame by frame.

The following will describe a process executed by the saturation correction section 80 according to the first embodiment. Through the above described process (brightness correction) in the brightness correction section 44, it is possible to retain an average luminance of a display image even when dimming is performed. That is, it is possible to perform dimming of the backlight 32 for power saving while suppressing a decrease in brightness of an image. However, only with the above brightness correction, there is a possibility that saturations decrease over the entire image after the process and the carnality of the image display then decreases. This is presumably because a color gamut is reduced due to dimming and saturations S (color differences Cb, Cr), as well as luminances, are also reduced to α times of the original saturations S. Thus, in the present embodiment, not only a process to enhance the luminances Y but also a process to enhance the color differences Cb, Cr (enhanced saturation correction) is executed. Specifically, the saturation correction section 80 enhances the color differences Cb, Cr. More specifically, the saturation correction section 80 executes enhanced saturation correction so that an average saturation is retained even when dimming is performed. That is, saturation correction is executed so that an average saturation does not change even when the amount of source light is changed.

The saturation correction section 80 executes saturation correction so that the saturations are approximated to a predetermined saturation reference. Specifically, in accordance with the following equation, the color differences cb, cr are converted to color differences Cb, Cr. And, the word "saturation correction" is the same meaning as the word "chroma correction". Within this document, it explains using the word "saturation correction".

$$Cb = Fc(cb) \times Gc + cb \quad \text{Equation (19)}$$

$$Cr = Fc(cr) \times Gc + cr \quad \text{Equation (20)}$$

Here, "cb, cr" are color differences after color conversion in the color conversion section 40, "Gc" is a correction amount at a predetermined saturation (hereinafter, referred to as "saturation correction amount"), and "Fc(C)" is a correction coefficient (hereinafter, referred to as "saturation correction coefficient") that indicates a ratio of a correction value to the reference correction amount Gc at each color difference value. The following will describe a method of determining a correction curve shown in Equation (19) and Equation (20), that is, a method of determining saturation correction coefficients Fc(C) and a saturation correction amount Gc one by one.

Figure 7A:
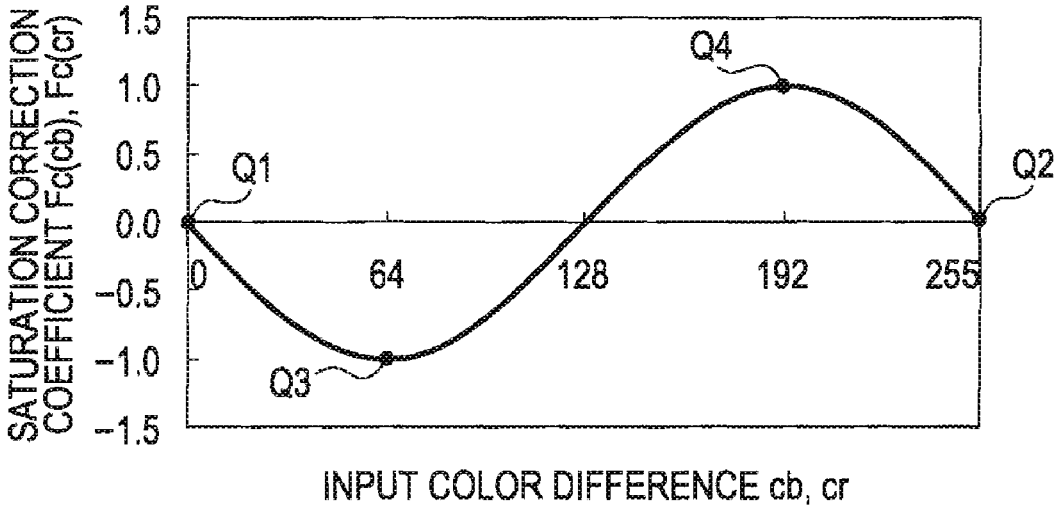
FIG. 7A and FIG. 7B are views that are used for explaining saturation correction coefficients.
Figure 7B:
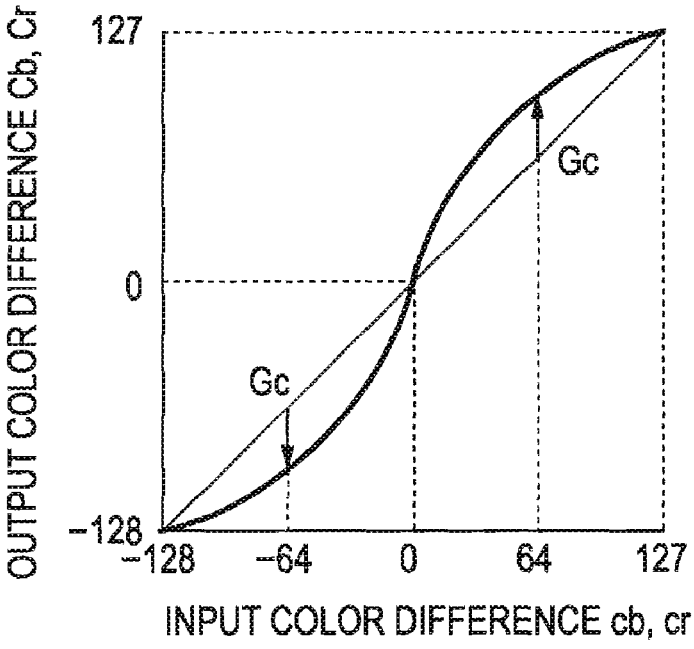

The saturation correction coefficients Fc(C) employ a function that is determined in advance. The saturation correction coefficients Fc(C) will be described with reference to FIG. 7A and FIG. 7B. FIG. 7A shows the relationship between the color difference values cb, cr and the saturation correction coefficients Fc(C). FIG. 7B shows the relationship between the input color differences cb, cr and the output color differences Cb, Cr when saturation correction is executed on the basis of the saturation correction coefficients Fc(C).

The saturation correction coefficients Fc(C), as shown in FIG. 7A, are given as a curve that has correction points of "64" and "192", which are color difference values used as correction references. The saturation correction coefficients Fc(C) are expressed by a curve that passes Q1(0,0)), at which Fc(C) is "0" and the color difference value is "0", and Q2(255, 0), at which Fc(C) is "0" and the color difference value is "255", Q3(64,−1), at which Fc(C) is "−1" and the color difference value is "64", that is, the correction point, and Q4(192,1), at which Fc(C) is "1" and the color difference value is "192", that is, the correction point. In the first embodiment, the saturation correction coefficients Fc(C) are given as a function that is shown by a cubic spline curve and are coefficients that are obtained by offsetting the function at "+128". By executing correction using the above saturation correction coefficients Fc(C) the color differences cb, cr (input color differences) are converted as shown in FIG. 7B. Note that the data of the saturation correction coefficients Fc(C) shown in FIG. 7A are stored in advance in the saturation correction coefficient storage section 81 as a table that contains values of Fc(C) corresponding to values that the color difference values cb, cr can take.

In addition, the saturation correction amount Gc is given by the following equation.

$$Gc = Gs(s\text{th} - s\text{ave}) \quad \text{equation (21)}$$

Here, "Gs" is a saturation correction intensity coefficient and is a predetermined value of 0 or above, "sth" is a saturation reference (reference saturation value), and "save" is an average saturation. In this case, the saturation s is expressed as "s=(|cb|+|cr|)/2". Note that the value of the saturation correction intensity coefficient Gs and the saturation reference sth may be determined as constants in advance or may be set by a user. Alternatively, the value of the saturation correction intensity coefficient Gs and the saturation reference sth may be determined in coordination with types of image data.

As is apparent from Equation (21), the saturation correction amount Gc is proportional to a value obtained by subtracting the average saturation save from the saturation reference sth, so that, when the saturation values S are corrected in accordance with the saturation correction amount Gc, the saturation values S are corrected so as to be approximated to the saturation reference sth. Thus, it is possible to reduce biased saturation values of image data.

Note that the saturation correction may be executed when the saturation correction amount Gc is determined through Equation (19) and Equation (20); however, actually in the present embodiment, the saturation correction amount Gc that is calculated in the saturation correction amount computing section 85 is transferred to the enhanced saturation correction amount computing section 86 as a parameter without calculation of Equation (19) and Equation (20).

The saturation correction section 86, by further executing correction in accordance with the following equation, executes enhanced saturation correction to reduce variation in saturations, which occurs in an image displayed due to light control while correcting biased saturation values. The correction equation of the enhanced saturation correction is defined by the following equation.

$$Cb'(cb)=Fc(cb)\times Gc1+cb \quad \text{Equation (22)}$$

$$Cr'(cr)=Fc(cr)\times Gc1+cr \quad \text{Equation (23)}$$

In Equation (22) and Equation (23), "Gc1" indicates the enhanced saturation correction amount. In this embodiment, the enhanced saturation correction amount Gc1 is determined so that the product of the average value of saturation values S' determined from color differences Cb', Cr', for which enhanced saturation correction is executed, and the light control rate α is equal to the average value of saturation values S determined from the color differences Cb, Cr, for which normal saturation correction is executed. That is, the enhanced saturation correction amount Gc1 is determined so as to satisfy the following Equation (24).

$$\alpha\times S'\text{ave}=S\text{ave} \quad \text{Equation (24)}$$

Equation (24) indicates that the saturations that display an image based on the color differences Cb, Cr are visually made equal to the saturations that display an image based on the color differences Cb', Cr' after light control. Note that the light control rate α uses a value that is finally determined by the brightness correction section 44. Here, the right-hand side and left-hand side of Equation (24) may be expressed as the following equation.

$$S\text{ave}=\Sigma S/N=(\Sigma|Fc(cb)|\times Gc+\Sigma|cb|+\Sigma|Fc(cr)|\times Gc+\Sigma|cr|)/N \quad \text{Equation (25)}$$

$$S'\text{ave}=\Sigma S'/N=(\Sigma|Fc(cb)|\times Gc1+\Sigma|cb|+\Sigma|Fc(cr)|\times Gc1+\Sigma|cr|)/N \quad \text{Equation (26)}$$

Through Equation (24) to Equation (26), the following equation that expresses the enhanced saturation correction amount Gc1 may be obtained.

$$Gc1=Gc/\alpha+\{(1-\alpha)(\Sigma|cb|+\Sigma|cr|)\}/\{\alpha(\Sigma|Fc(cb)|+\Sigma|Fc(cr)|)\} \quad \text{Equation (27)}$$

Here, the enhanced saturation correction amount Gc1 that appears in Equation (27) is not as a function of the Saturation values S but as a function of the saturation correction amount Gc, so that the saturation correction section 80 is able to calculate the enhanced saturation correction amount Gc1 on the basis of the saturation correction amount Gc without calculation using Equation (19) actually. Using the thus calculated enhanced saturation correction amount Gc1, it is possible to execute enhanced saturation correction that reduces variation in saturations due to light control after biased saturation values are corrected. Thus, the saturation correction section 80 may be regarded as an image correction device according to the invention.

Subsequently, the light source control section 48 controls the amount of source light (that is, "light source luminance") generated by the backlight 32 so that the light source control section 48 controls power supplied from the power supply unit 31 to the backlight 32 in accordance with the light control rate α. That is, the light source control section 48 executes light control. Here, the light control rate α is a value that is made in consideration of sensitivity characteristic of the visual sense of a human being, so that a light source light control rate K that indicates a ratio of an actual amount of light to a predetermined amount of light emitted from the backlight 32 may be determined as the following equation using a gamma coefficient γ.

$$K=\alpha\gamma \quad \text{Equation (28)}$$

For example, the gamma coefficient γ is a value such as "2.2". Using Equation (28), the light source light control rate K that indicates a ratio of amount of light by which the backlight 32 is actually dimmed from the light control rate α that is made in consideration of the visual characteristic of a human being. When the light control rate α is "1", the light control rate K of the backlight 32 is "1". Thus, the backlight 32 emits a maximum amount of light.

In addition, because the amount of light emitted from the backlight 32 is generally proportional to the luminances of an image displayed on the display panel 30, so that the relationship between actual luminances L of an image displayed on the display panel 30 when light control is performed and actual luminances LU0 of an image when light control is not performed may be expressed as the following equation.

$$LU=K\times LU0 \quad \text{Equation (29)}$$

For example, when the light control rate α is set to "0.85" in order to reduce 15% of luminance that is visually sensed by a human being, because the gamma coefficient γ is "2.2", the light source light control rate K is "0.7" from Equation (28). From Equation (29), the luminance L when light control is performed may be reduce by 30% as compared to the luminance LU0 when no dimming is performed. Thus, it is possible to reduce power supplied to the backlight 32. The light source control section 48 performs light control in such a manner that the light source light control rate K is calculated from the light control rate α using Equation (28) and a control signal that controls power supplied to the backlight 32 in accordance with the light source light control rate K is sent to the power supply unit 31.

The image display signal generating section 45 converted the luminance values Y', for which brightness correction is performed, and the color difference data Cb', Cr', for which saturation correction is performed, to RGB data. In this case, in accordance with the following equation that converts luminance data and color difference data to RGB data, the RGB data, for which brightness correction is performed, may be obtained. Note that conversion of Equation (30) to Equation (32) may also be executed using a color conversion table actually.

$$R=Y'+1.4020Cr' \quad \text{Equation (30)}$$

$$G=Y'-0.3441Cb'-0.7139Cr' \quad \text{Equation (31)}$$

$$B=Y'+1.7718Cb'-0.0012Cr' \quad \text{Equation (32)}$$

In addition, the image display signal generating section 45 sends a generated image display signal to the display panel 30 while synchronizing with the timing when the light source control section 48 controls a light source. Then, the display panel 30, on the basis of the received image display signal, controls the amount of transmission for each pixel by modulating light emitted from the backlight 32, thus displaying an image.

As described above, according to the first embodiment, because enhanced saturation correction is performed in correspondence with dimming, it is possible to perform light control (power saving) without a decrease in saturations while retaining high image quality. That is, according to the present embodiment, it is possible to appropriately execute dimming of the backlight 32 for power saving while not only suppressing a decrease in luminances (brightness) of a display image but also effectively suppressing a decrease in saturations.

Saturation Correction Process

Figure 8:
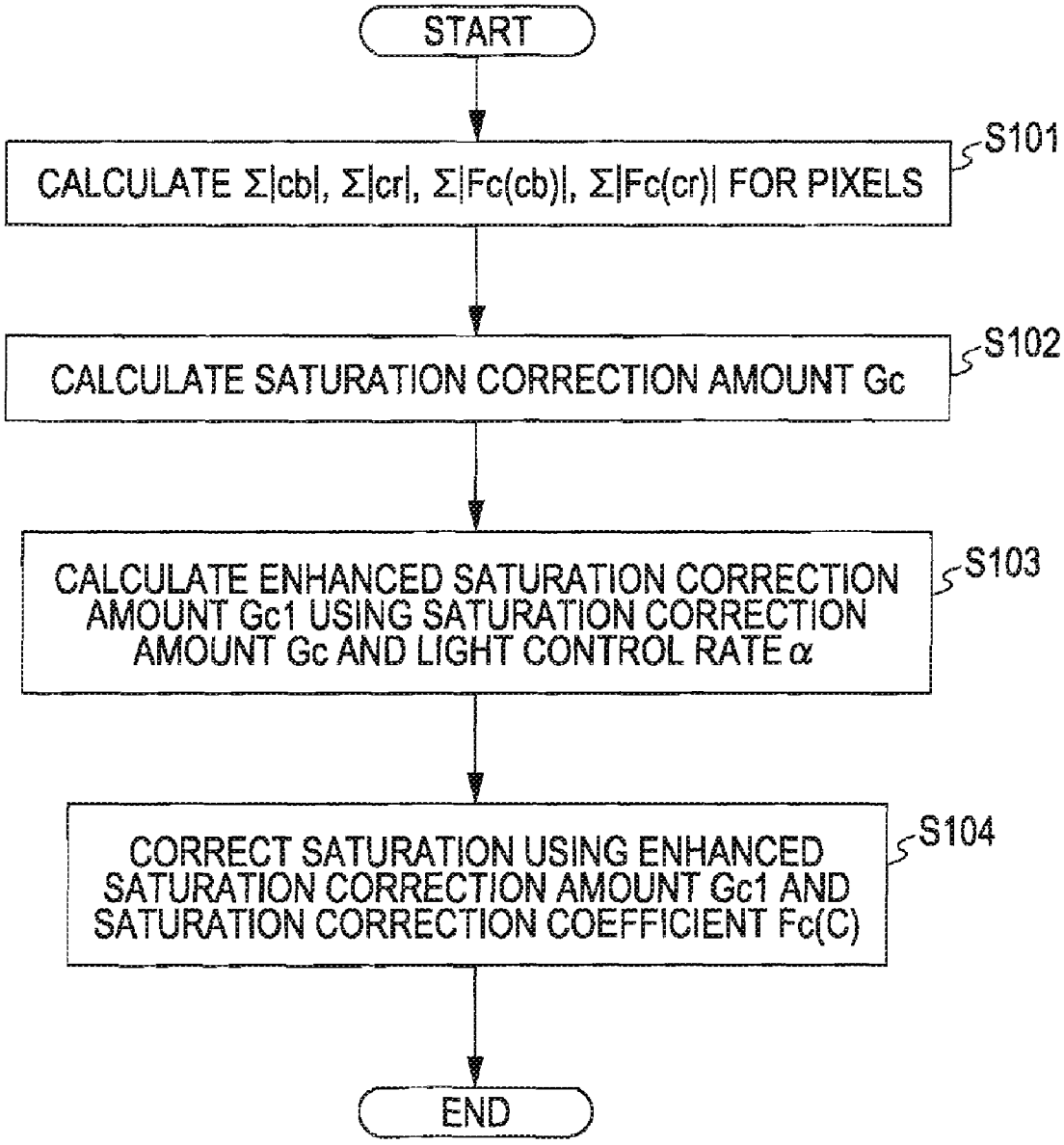
FIG. 8 is a flowchart that shows a saturation correction process according to the first embodiment of the invention.

The following will describe a saturation correction process that is executed by the saturation correction section 80 with reference to FIG. 1. FIG. 8 is a flowchart that shows a saturation correction process executed by the saturation correction section 80.

At first, in step S101, the saturation correction section 80 calculates Σ|cb|, Σ|cr|, Σ|Fc(cb)|, and Σ|Fc(cr)| for pixels from input color differences cb, cr. Specifically, the color difference summation computing section 82 of the saturation correction section 80 calculates Σ|cb| and Σ|cr|, while the coefficient summation computing section 84 of the saturation correction section 80 calculates Σ|Fc(cb)| and Σ|Fc(cr)|. In this case, the color difference summation computing section 82 and the coefficient summation computing section 84 execute a process when each frame image is being input. When the above process is completed, the process proceeds to step S102.

In step S102, the saturation correction amount computing section 85 of the saturation correction section 80 calculates a saturation correction amount Gc. Specifically, the saturation correction amount computing section 85 acquires an average saturation save from the average saturation computing section 83 and substitutes the above described Equation (21) using the acquired average saturation save, thus calculating the saturation correction amount Gc. Note that the average saturation computing section 83 calculates the average saturation save using Σ|cb| and Σ|cr| that are calculated in step 101. When the above process is completed, the process proceeds to step S103.

In step S103, the enhanced saturation correction amount computing section 86 of the saturation correction section 80 calculates an enhanced saturation correction amount Gc1 using the saturation correction amount Gc and the light control rate α. In this case, the saturation correction amount Gc is a value that is calculated in the saturation correction amount computing section 85 in step S102, and the light control rate α is a value that is acquired from the light control rate computing section 71. Specifically, the enhanced saturation correction amount computing section 86 calculates the enhanced saturation correction amount Gc1 on the basis of the above described Equation (27). In this case, the enhanced saturation correction amount computing section 86 calculates the enhanced saturation correction amount Gc1 by substituting Equation (27) using the saturation correction amount Gc acquired from the saturation correction amount computing section 85, the light control rate α acquired from the light control rate computing section 71, Σ|cb| and Σ|cr| acquired from the color difference summation computing section 82, and Σ|Fc(cb)| and Σ|Fc(cr)| acquired from the coefficient summation computing section 84. Then, the process proceeds to step S104. Note that the processes of step S102 and step S103 are executed after each frame image has been input.

In step S104, the saturation correction execution section 87 of the saturation correction section 80 executes saturation correction on image data using the enhanced saturation correction amount Gc1 that is calculated in step S103 and the saturation correction coefficients Fc(C) stored in the saturation correction coefficient storage section 81. In this case, the saturation correction execution section 87 executes saturation correction on the next frame image. When the above processes are completed, the process escapes the flow.

According to the above saturation correction process, because enhanced saturation correction is performed in correspondence with dimming, it is possible to perform light control without a decrease in saturations while retaining high image quality. That is, it is possible to reduce power consumption while effectively suppressing a decrease in saturations of an image.

Figure 9A:
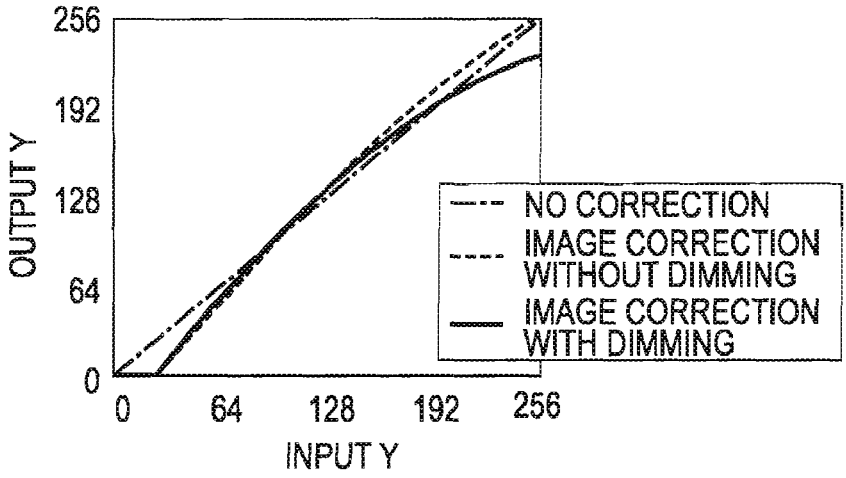
FIG. 9A to FIG. 9C are views that show a specific example of the result when the saturation correction process is executed.
Figure 9B:
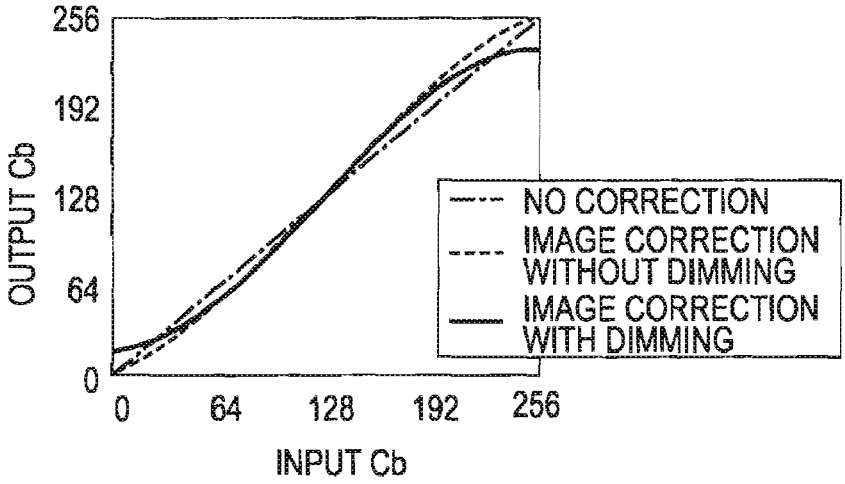
Figure 9C:
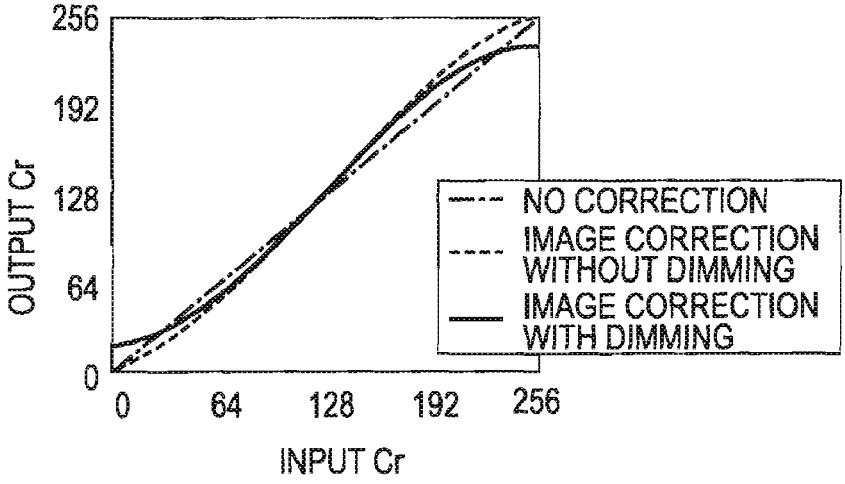

Here, a specific example of the result when the saturation correction process is executed will be described with reference to FIG. 9A to FIG. 9C. In each of FIG. 9A to FIG. 9C, the abscissa axis indicates input values, and the ordinate axis indicates output values when image correction is performed. In addition, in FIG. 9A to FIG. 9C, the dotted line indicates original data without correction, the broken line indicates data when image correction is performed without dimming, and the solid line indicates data when image correction is performed with dimming (that is, the data when saturation correction according to the present embodiment is performed). Furthermore, FIG. 9A shows input/output characteristics of luminances Y. FIG. 9B shows input/output characteristics of color differences Cb. FIG. 9C shows input/output characteristics of color differences Cr. Note that the color differences Cb, Cr are offset at "+128". As is apparent from the solid line in FIG. 9A to FIG. 9C, according to the saturation correction of the present embodiment, it turns out that the luminances and color differences, which are equivalent to those without dimming, are reproduced in an intermediate gray scale level region.

Second Embodiment

Figure 10A:
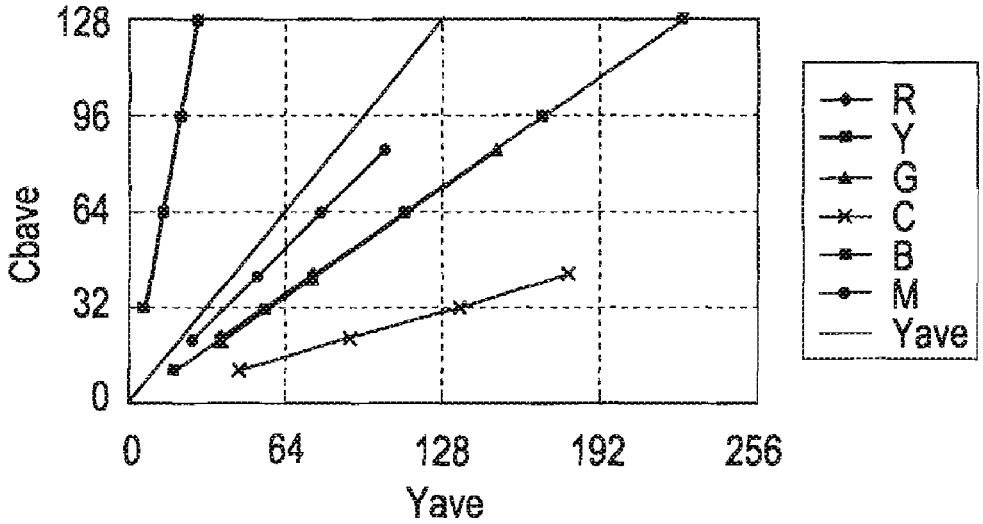
FIG. 10A and FIG. 10B are views that show an example of the relationship between luminances and color differences.
Figure 10B:
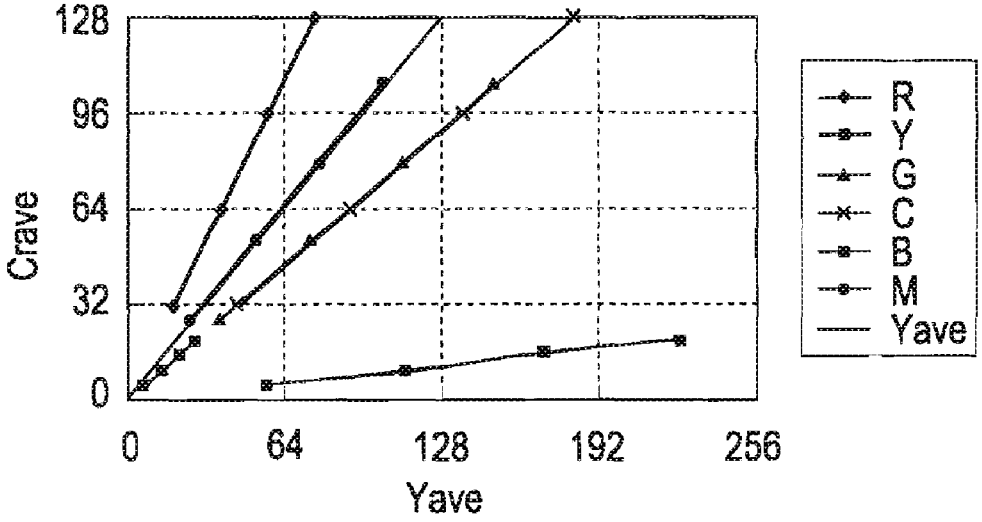

The following will describe a second embodiment of the invention. The second embodiment differs from the first embodiment in that, in addition to the above described saturation correction, a process to determine the amount of source light in accordance with the luminance and color difference of image data is executed. The reason why the above process is executed will be described below. Owing to the above described brightness correction, the average luminance may be retained in a display image even when dimming is performed. However, there is a possibility that an extreme decrease in saturations occurs in an image having a high saturation colors such as red (R) and blue (B). Red or blue has a high saturation but has a small value in luminance. Therefore, the above steep decrease in saturations is presumably caused by excessive dimming. Specifically, a description will be made with reference to FIG. 10A and FIG. 10B. FIG. 10A and FIG. 10B are views that show the relationship between the luminances Y and the color differences Cb, Cr at RGBCMY(64,128,192,255) ("C" indicates cyan, "M" indicates magenta, "Y" indicates yellow). FIG. 10A proves that blue primary color has large color differences Cb even at small luminances Y. FIG. 10B proves that red primary color has large color differences Cr even at small luminances Y. Thus, in the second embodiment, for such high saturation red and blue, the amount of source light is determined on the basis of not luminances but saturations (color differences).

In the above described first embodiment, image correction is performed by converting RGB to YCbCr using Equation (1) to Equation (3). However, because R and B contribute to the luminances Y to a less degree than G, it is recognized as a dark image even when it is a bright image. For example, when (R,G,B)=(0,0,255), Y=29 (or 30). Thus, it should be bright blue but it has a luminance equivalent to a dark gray. That is, when the backlight is dimmed for a dark image, it may excessively dim a high saturation R or B and cause an image not to be reproduced appropriately. Thus, in the second embodiment, the amount of source light is determined (that is, dimmed) in consideration of saturations S as well as luminances Y. Specifically, the amount of source light is determined on the basis of a value specified by luminances or a value specified by saturations, whichever is larger. In this manner, a high saturation image is appropriately determined, and, for the high saturation image, dimming is suppressed even when luminances are low.

Specifically, in the second embodiment, a high saturation image is determined in a YCbCr space. Light control may be performed using a maximum value of RGB or a maximum value of averages of RGB. However, when an input image is originally YCbCr data, it is necessary to provide an additional RGB conversion circuit in addition to a YCbCr to RGB conversion circuit of the image display signal generating section 45. Thus, it may increase costs. For the above reason, in the second embodiment, a determination of high saturation image is performed on the basis of YCbCr data in place of RUB data. Specifically, the average values are taken respectively from YCbCr and the maximum value among the average values is used. In this case, "2Cb" and "2Cr" are determined using the following Equation (33) and Equation (34) that are transformed from the above Equation (1) to Equation (3).

$$2Cb = B - \left(\frac{22}{64}R + \frac{42}{64}G\right) \quad \text{Equation (33)}$$

$$2Cr = R - \left(\frac{54}{64}G + \frac{10}{64}B\right) \quad \text{Equation (34)}$$

From Equation (33) and Equation (34), when (R,G,B)=(255,0,0), 2Cr=255, and when (R,G,B)=(0,0,255), 2Cb=255. Thus, the same scale (0 to 255) may be used as that of Y. Thus, in the present embodiment, a determination of high saturation image is performed using "2|Cb|" and "2|Cr|". Specifically, a determination of high saturation image is performed by comparing average values of luminances Y, twice the average values of color differences cb, and twice the average values of color differences cr. Note that C (cyan) and Y (yellow), which are complementary colors of R and B, may also be determined from "2|Cb|", "2|Cr|". In addition, G and its complementary color M (magenta) does not take 255, in any one of "Y", "2|Cb|", "2|Cr|". When (R,G,B)=(0,255,0), 2|Cr|=216. Thus, there is no large influence.

Configuration of Image Processing Engine

Figures 11, 11A:
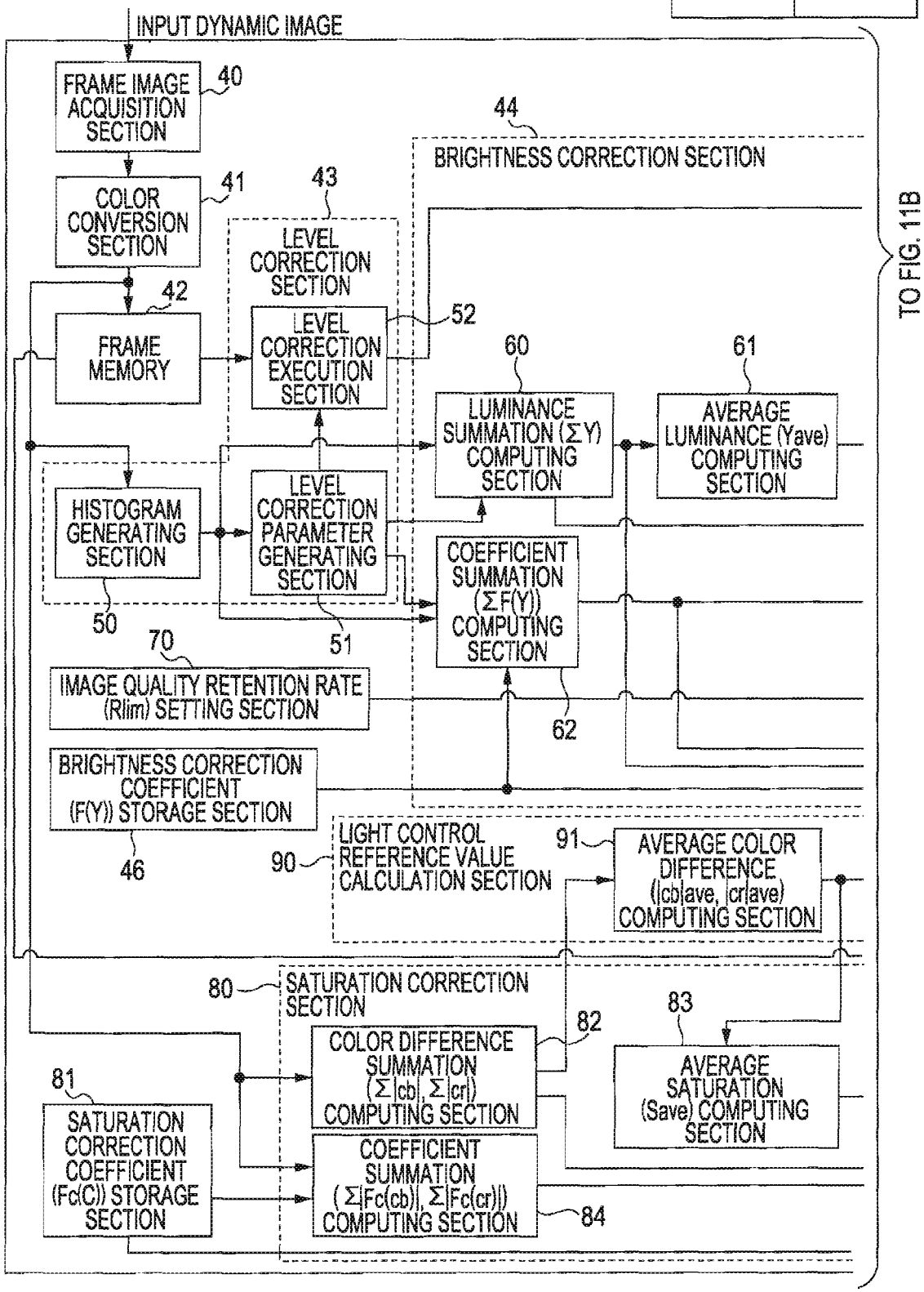
FIG. 11 is a view that shows the configuration of an image processing engine according to a second embodiment of the invention.
Figure 11B:
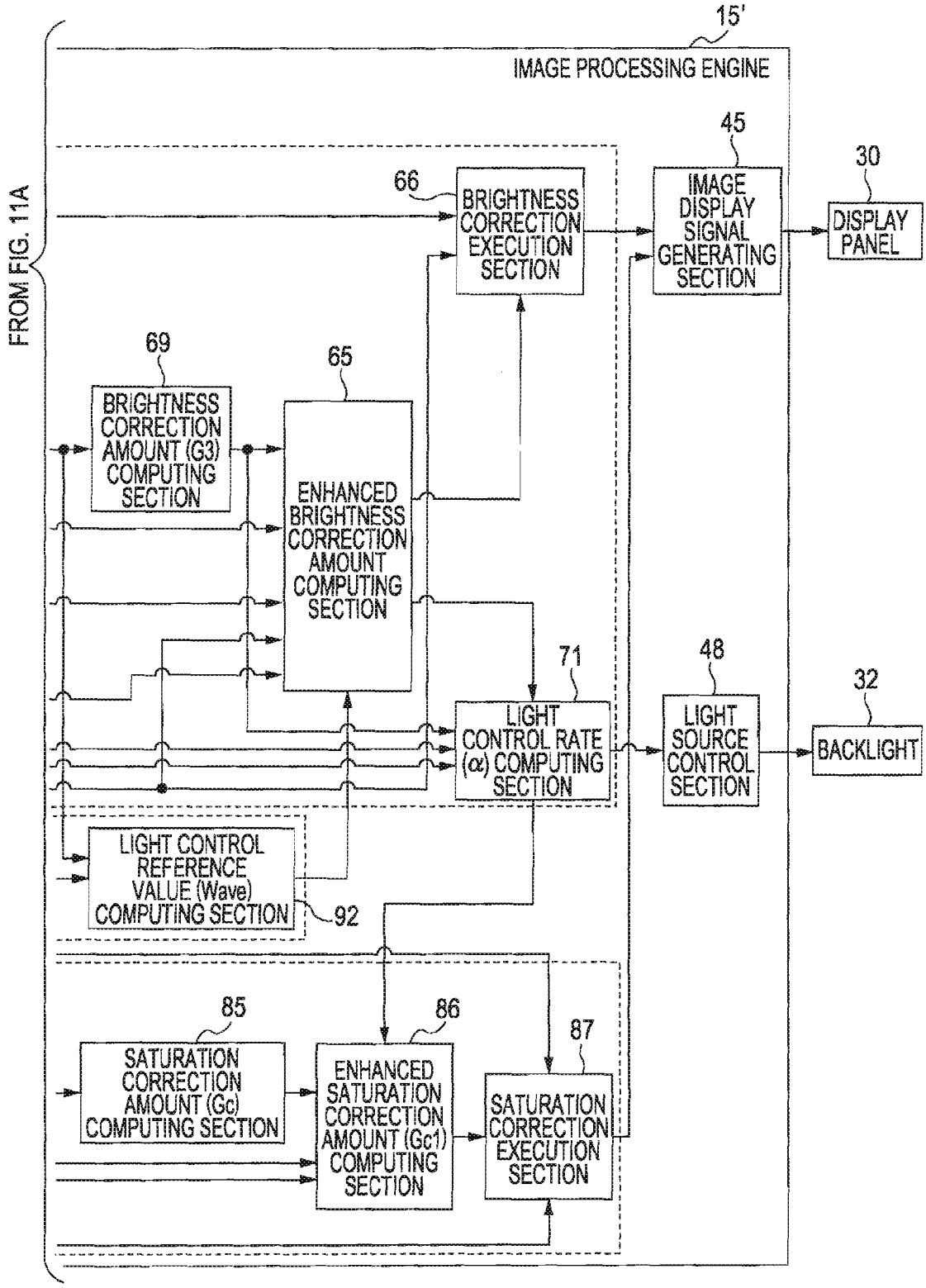

FIG. 11 shows a configuration of an image processing engine according to the second embodiment. The image processing engine 15' according to the second embodiment may also be applied to the image display device 1 (see FIG. 1). The image processing engine 15' according to the second embodiment differs from the image processing engine 15 according to the first embodiment in that the image processing engine 15' includes a light control reference value calculation section 90. The same reference numerals are assigned to the same components as those of the image processing engine 15 according to the first embodiment and a description thereof is omitted.

The light control reference value calculation section 90 includes an average color difference computing section 91 and a light control reference value computing section 92. The average color difference computing section 91 acquires Σ|cb| and Σ|cr| that are calculated by the color difference summation computing section 82 of the brightness correction section 44 and, using these summations, calculates average color differences |cb|ave and |cr|ave. In addition, the light control reference value computing section 92 acquires the average color differences |cb|ave, |cr|ave, and the like, from the average color difference computing section 91 and, using these average color differences, calculates a light control reference value Wave. Specifically, the light control reference value computing section 92 determines the light control reference value Wave on the basis of the following Equation (35).

$$Wave = \max(Yave, 2|cb|ave, 2|cr|ave) \quad \text{Equation (35)}$$

As is apparent from Equation (35), the light control reference value computing section 92 determines the average luminance Yave, twice the average value of the color differences cb (2|cb|ave), or twice the average value of the color differences (2|cr|ave), whichever is the maximum value, as the light control reference value Wave.

In this manner, the light control reference value Wave that is calculated by the light control reference value calculation section 90 is supplied to the enhanced brightness correction amount computing section 65 of the brightness correction section 44. The enhanced brightness correction amount computing section 65 determines a limit correction amount G4*lim*' on the basis of the light control reference value Wave. In this case, the enhanced brightness correction amount computing section 65 defines Rlim' by changing the reference input gray scale value from "Yave" to "Wave". Specifically, Rlim' is determined using the following Equation (36) which is modified from the above described Equation (15). Note that the limit light control rate αlim that appears in Equation (36) is expressed as the above described Equation (16)

$$Rlim' = \alpha lim \times (255 - (F(Wave)G4lim' + Wave))/(255 - (F(Wave) \times G3 + Wave)) \quad \text{Equation (36)}$$

From Equation (16) and Equation (36), the limit correction amount G4*lim*' may be determined using the following Equation (37).

$$G4\lim' \frac{\{R\lim \times F(\text{Wave}) \times \Sigma Y + (255 - \text{Wave}) \times \Sigma F(Y)\} \times G3 + (1 - R\lim) \times (255 - \text{Wave}) \times \Sigma Y}{(1 - R\lim) \times F(\text{Wave}) \times \Sigma F(Y) \times G3 + F(\text{Wave}) \times \Sigma Y + R\lim \times (255 - \text{Wave}) \times \Sigma F(Y)} \quad \text{Equation (37)}$$

Then, by substituting Equation (16) using the limit correction amount G4*lim*' that is determined from Equation (37), it is possible to obtain a limit light control rate αlim. In addition, by substituting Equation (28) using the limit light control rate αlim, it is possible to obtain a light source light control rate K (hereinafter, this "K" referred to as "luminance lower limit value Klim") that indicates a lower limit value of luminances. Using the thus obtained limit correction amount G4*lim*' and luminance lower limit value Klim, light control and image correction are executed. As described above, the light control reference value calculation section 90 and the brightness correction section 44 may be regarded as a source light amount control device of the invention.

As described above, according to the second embodiment, it is possible to determine the amount of source light by appropriately detecting a high saturation color (specifically, to suppress dimming in correspondence with a high saturation color). Thus, it is possible to appropriately execute dimming of the backlight 32 for power saving while suppressing a decrease in saturations of image data that contain a high saturation color. That is, because a high saturation color may be detected even when luminances of image data are small, it is possible to execute light control (power saving) with high image quality while effectively suppressing a decrease in saturations.

Furthermore, in the second embodiment, the light control reference value Wave may be simply obtained through calculation using characteristic amounts (Yave, |cb|ave, |cr|ave) that are used for normal image correction (brightness correction, saturation correction) in the luminance/color-difference signal mode (YCbCr) as it is. Thus, it is not necessary to add a large circuit (a YCbCr to RGB conversion circuit and a high saturation detection circuit in RGB mode). Hence, there is no possibility to increase costs.

Procedure

Figure 12:
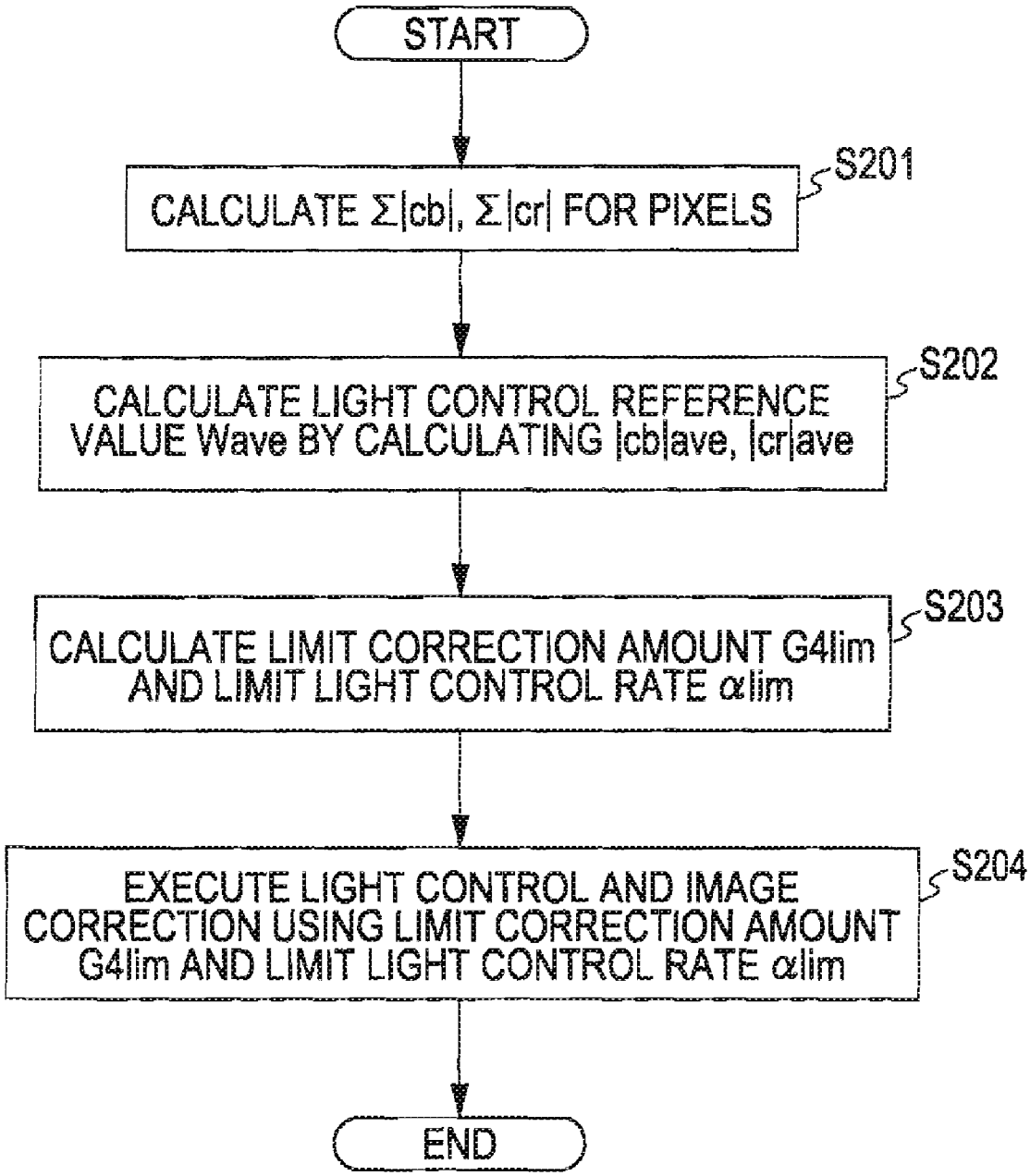
FIG. 12 is a flowchart that shows a process according to the second embodiment of the invention.

The following will describe a process executed when the limit correction amount G4*lim*', and the like, is obtained on the basis of the light control reference value Wave with reference to FIG. 12. FIG. 12 is a flowchart that shows a process executed mainly by the brightness correction section 44 and the light control reference value calculation section 90.

At first, in step S201, the color difference summation computing section 82 of the saturation correction section 80 calculates Σ|cb| and Σ|cr| for each pixel using input color differences cb, cr. In this case, the color difference summation computing section 82 executes a process when each frame image is being input. When the above process is completed, the process proceeds to step S202.

In step S202, the light control reference value calculation section 90 calculates the average color differences |cb|ave and |cr|ave and also calculates the light control reference value Wave. In this case, the average color difference computing section 91 of the light control reference value calculation section 90 acquires Σ|cb| and Σ|cr| that are calculated by the color difference summation computing section 82 of the saturation correction section 80 and, using these summations, calculates the average color differences |cb|ave and |cr|ave. In addition, the light control reference value computing section 92 of the light control reference value calculation section 90 acquires the average color differences |cb|ave and |cr|ave that are calculated by the average color difference computing section 91 and determines the light control reference value Wave on the basis of the above described Equation (35). When the above process is completed, the process proceeds to step S203.

In step S203, the brightness correction section 44 calculates the limit correction amount G4*lim*' and the limit light control rate αlim. Specifically, the enhanced brightness correction amount computing section 65 of the brightness correction section 44 acquires the light control reference value Wave from the light control reference value calculation section 90 and then calculates the limit correction amount G4*lim*'. Specifically, the enhanced brightness correction amount computing section 65 obtains the limit correction amount G4*lim*' by substituting Equation (37) using the acquired light control reference value Wave. Then, by substituting Equation (16) using the obtained limit correction amount G4*lim*', the limit light control rate αlim is obtained. Furthermore, by substituting Equation (28) using the limit light control rate αlim, the luminance lower limit value Klim is obtained. When the above process is completed, the process proceeds to step S204. Note that the processes of step S202 and step S203 are executed after each frame image has been input.

In step S204, using the limit correction amount G4*lim*' and the limit light control rate αlim (luminance lower limit value Klim) that are obtained in step S203, light control and image correction are executed. Specifically, the brightness correction execution section 66 executes image correction, and the light source control section 48 executes light control. Note that, actually, in addition to the above described image correction, saturation correction described in the first embodiment is also executed by the saturation correction section 80. In this case, the saturation correction section 80 executes saturation correction using the limit light control rate αlim that is obtained in the process of step S203. When the above processes are completed, the process escapes the flow. Note that the process of step S204 is executed on the next frame image.

According to the above processes, because a high saturation color may be detected even when luminances of image data are small, it is possible to execute light control with high image quality while effectively suppressing a decrease in saturations.

Note that, in the above described example, the light control reference value computing section 92 calculates the light control reference value Wave by comparing an average value Yave of the luminances, twice the average value of the color differences cb, and twice the average value of the color differences cr, but it is not limited to it. In another example, the light control reference value computing section 92 may calculate the light control reference value Wave by comparing the average value Yave of the luminances and twice the average value Save of saturations, each of which is defined by taking the average of the color difference cb and the color difference cr (that is, saturations S are obtained using "S=(|cb|+|cr|)/2". In other words, the light control reference value computing section 92 calculates the light control reference value Wave on the basis of the following Equation (38).

$$\text{Wave}' = \max(\text{Yave}, 2\text{Save}) \quad \text{Equation (38)}$$

In this case, as is apparent from Equation (38), the light control reference value computing section 92 determines the maximum value from among the average luminance Yave and twice the average value Save of saturations, each of which is defined by taking the average of the color difference cb and the color difference cr, as the light control reference value Wave'. Note that, when Equation (38) is used, information indicating the color differences cb, cr are averaged. Thus, it is more accurate by calculating the light control reference value Wave using the above described Equation (35) than by calculating the light control reference value Wave, using this Equation (38). This is because, in Equation (35), the light control reference value Wave is determined using "2|cr|" and "2|cb|" without averaging information of the color differences cb, cr.

Figure 13A:
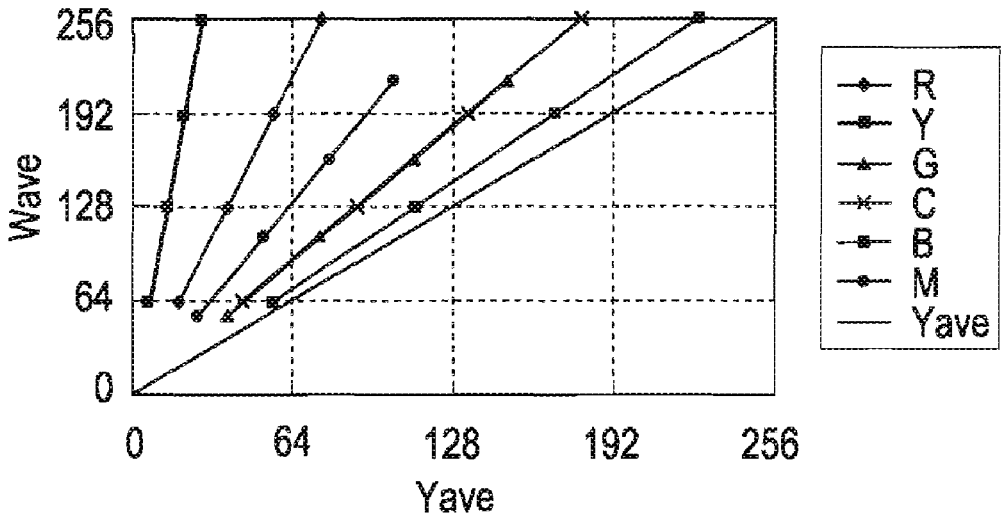
FIG. 13A and FIG. 13B are views that show the relationship between an average brightness and a light control reference value.
Figure 13B:
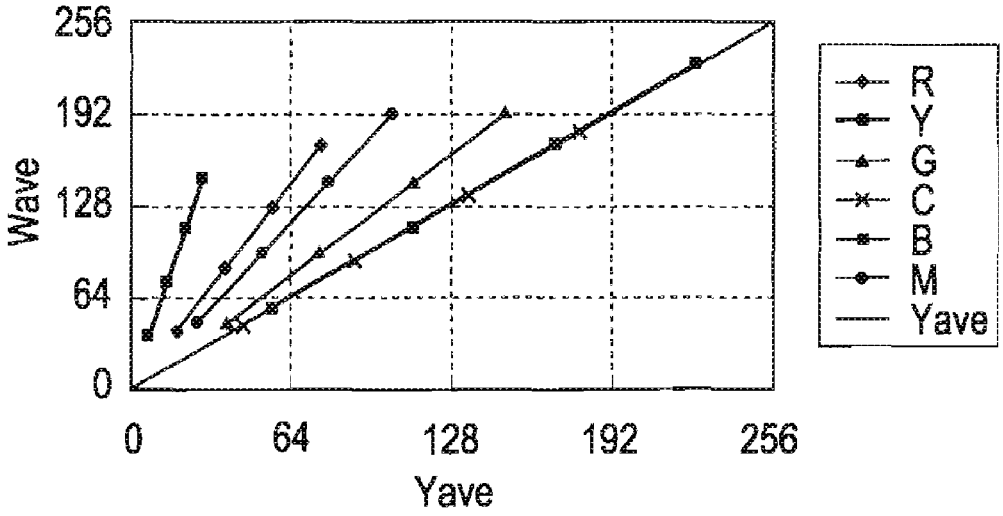

FIG. 13A is a view that shows the light control reference value Wave that is obtained by Equation (35). FIG. 13B is a view that shows the light control reference value Wave' that is obtained by Equation (38). In each of FIG. 13A and FIG. 13B, the abscissa axis indicates an average luminance Yave, and the ordinate axis indicates a light control reference value Wave or Wave'. FIG. 13A proves that high saturations of primary colors, such as blue and red, are appropriately reflected in the light control reference value Wave. Note that RGBCMY all obtain the light control reference values Wave not using luminances but using color differences. On the other hand, FIG. 13B proves that high saturations of primary colors, such as blue and red, are more reflected for the light control reference value Wave' than using only the luminances Y, but the values are smaller than the values shown in FIG. 13A. In addition, because Y (yellow) and C are larger in luminance than in saturation, the average luminance Yave is used for the light control reference value Wave'.

Alternative Examples

The above described calculations are basically presumed to be performed in a circuit at timing between the adjacent frames of a dynamic image, but the calculations may be executed through software processing. For example, the function implemented in the components of the image processing engine 15 or 15' may be implemented through an image display program, that is executed by the CPU (computer) 11. Note that the image display program may be stored in the hard disk 14 or in the ROM 12 in advance, or the image display program may be externally supplied through a computer readable recording medium, such as the CD-ROM 22, and then the image display program read by the CD-ROM drive 16 may be stored in the hard disk 14. In addition, the image display program may be stored in the hard disk 14 by accessing to a server, or the like, that supplies the image display program and then downloading the data through a network device, such as an internet.

Furthermore, some of functions may be implemented in a hardware circuit the other functions, which are not implemented in the hardware circuit, may be implemented by software. For example, histograms, ΣY, Σ|cb|, Σ|cr|, ΣF(Y), Σ|Fc(cb)|, Σ|Fc(cr)|, and the like, which are processed for pixels, may be implemented in the circuit, and average values, light control rates, image correction amounts, which are calculated for each frame, may be executed by the CPU 11 through software processing at timing between the adjacent frames. Moreover, when a still image display is intended as a photo viewer or when a dynamic image is converted in advance to dimmed data and a corrected dynamic image before display, all the functions may be executed through software processing.

Electronic Apparatuses

Figure 14A:
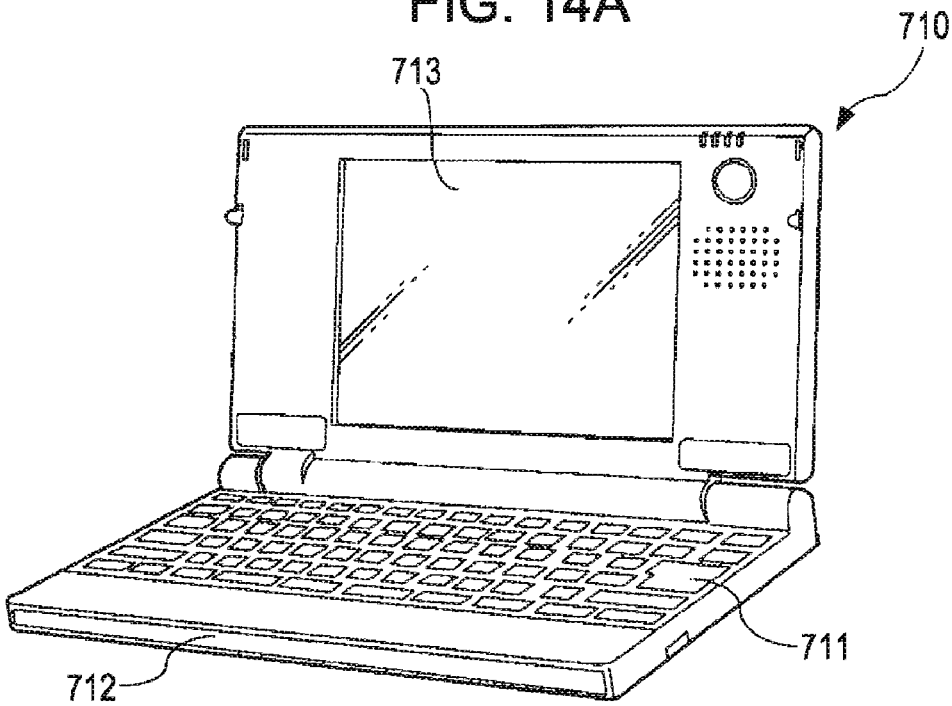
FIG. 14A and FIG. 14B are views that show specific examples of an electronic apparatus to which the image display device is applicable.
Figure 14B:
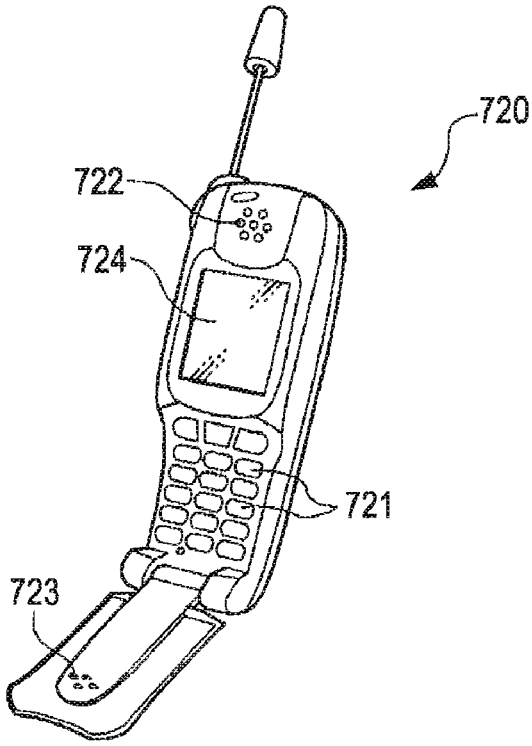

The following will describe specific examples of electronic apparatuses to which the image display device 1 according to the above described embodiments are applicable with reference to FIG. 14A and FIG. 14B.

At first, an example in which the image display device 1 according to the above described embodiments are applied to a display portion of a mobile personal computer (that is, a laptop personal computer) will be described. FIG. 14A is a perspective view that shows the configuration of the personal computer. As shown in the drawing, the personal computer 710 includes a body portion 712 having a keyboard 711 and a display portion 713 to which a liquid crystal device 100 according to the aspects of the invention is applied.

Subsequently, an example in which the image display device 1 according to the above described embodiments is applied to a display portion of a mobile telephone will be described. FIG. 14B is a perspective view that shows the configuration of the mobile telephone. As shown in the drawing, the mobile telephone 720 includes a plurality of operation buttons 721, an earpiece 722, a mouthpiece 723, and a display portion 724 to which the liquid crystal device 100 according to the aspects of the invention is applied.

Note that the electronic apparatus to which the image display device 1 according to the aspects of the invention is applicable is not limited to the above described examples.

What is claimed is:

1. An image display device that corrects image data, which are used for displaying an image, using a gray scale value assigned to each pixel and that also controls an amount of source light emitted from a light source, comprising:

a source light amount control device that determines the amount of source light and then controls the amount of source light; and an image correction device that calculates a saturation correction amount and corrects a signal used for changing saturations of the image data based on the saturation correction amount, so as to reduce a change in the saturations due to a change in the amount of source light, the change in the amount of source light being performed by the light source amount control device, wherein the image correction device corrects the signal so that an average value of saturations of image data, in which a signal for changing saturations has been corrected and the source light amount control device has controlled to change the amount of source light, is substantially equal to an average value of saturations of image data that have been corrected from image data, in which a signal for changing saturations has not been corrected, so that the saturations are approximated to a predetermined saturation reference.

2. The image display device according to claim 1, wherein the image correction device corrects the signal so as to reduce a change in an average value of the saturations of the image data when the source light control device controls to change the amount of source light.

3. The image display device according to claim 1, wherein the source light amount control device determines the amount of source light on the basis of luminances and saturations of the image data.

4. The image display device according to claim 3, wherein the source light amount control device determines the amount of source light on the basis of a value specified by the luminances or a value specified by the saturations, whichever is larger.

5. The image display device according to claim 4, wherein the value specified by the luminances includes an average value of the luminances, the value specified by the saturations includes twice an average value of color differences specified by blue-yellow axis and twice an average value of color differences specified by red-green axis, wherein the source light amount control device determines the amount of source light on the basis of a maximum value among the average value of the luminances, twice the average value of the color differences specified by blue-yellow axis, and twice the average value of the color differences specified by red-green axis.

6. The image display device according to claim 4, wherein the value specified by the luminances includes an average of the luminances, the value specified by the saturations includes twice an average value of saturations, each of which is defined by taking an average of a color difference specified by blue-yellow axis and a color difference specified by red-green axis, wherein the source light amount control device determines the amount of source light on the basis of a maximum value among the average value of the luminances and twice the average value of the saturations, each of which is defined by taking the average of a color difference specified by blue-yellow axis and a color difference specified by red-green axis.

7. The image display device according to claim 3, wherein the image correction device corrects the signal on the basis of the amount of source light that is determined by the source light amount control device.

8. An electronic apparatus comprising:

the image display device according to claim 1; and a power supply unit that supplies the image display device with voltage.

9. An image display method that corrects image data, which are used for displaying an image, using a gray scale value assigned to each pixel and that controls an amount of source light emitted from a light source, comprising:

determining the amount of source light and then controlling the amount of source light;

calculating a saturation correction amount; and correcting a signal used for changing saturations of the image data based on the saturation correction amount so as to reduce a change in the saturations due to a change in the amount of source light by controlling the amount of source light, so that an average value of saturations of image data, in which a signal for changing saturations has been corrected and controlled to change the amount of source light, is substantially equal to an average value of saturations of image data that have been corrected from image data, in which a signal for changing saturations has not been corrected, so that the saturations are approximated to a predetermined saturation reference.

10. A non-transitory computer readable recording medium comprising:

an image display program that executes a process to correct image data, which are used for displaying an image, using a gray scale value assigned to each pixel and that also executes a process to control an amount of source light emitted from a light source, the image display program comprising instructions to cause a computer to:

determine the amount of source light and then control the amount of source light;

calculate a saturation correction amount; and correct a signal used for changing saturations of the image data based on the saturation correction amount so as to reduce a change in the saturations due to a change in the amount of source light by controlling the amount of source light so that an average value of saturations of image data, in which a signal for changing saturations has been corrected and controlled to change the amount of source light, is substantially equal to an average value of saturations of image data which have been corrected from image data, in which a signal for changing saturations has not been corrected, so that the saturations are approximated to a predetermined saturation reference.

* * * * *